US012714234B2

(12) United States Patent
Leng

(10) Patent No.: US 12,714,234 B2
(45) **Date of Patent: *Aug. 25, 2026**

(54) ELASTIC MATTRESS FOR FURNITURE

(71) Applicant: Luhao Leng, Xiamen City (CN)

(72) Inventor: Luhao Leng, Xiamen City (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/783,131

(22) Filed: Jul. 24, 2024

(65) Prior Publication Data

US 2025/0194810 A1 Jun. 19, 2025

(30) Foreign Application Priority Data

Dec. 14, 2023 (CN) ..... 202311720549.3

(51) Int. Cl.
*A47C 23/00* (2006.01)
*A47C 27/06* (2006.01)
*A47C 27/07* (2006.01)

(52) U.S. Cl.
CPC ..... *A47C 23/002* (2013.01); *A47C 27/063* (2013.01); *A47C 27/07* (2013.01)

(58) Field of Classification Search
CPC ..... A47C 23/002; A47C 27/063; A47C 27/07; A47C 23/005; A47C 27/04; A47C 27/045; A47C 27/122
See application file for complete search history.

(56) References Cited

U.S. PATENT DOCUMENTS 1,837,847 A * 12/1931 Bowersox ..... A47C 27/065 5/247
5,395,097 A * 3/1995 Dabney ..... A47C 23/005 5/267

(Continued)

FOREIGN PATENT DOCUMENTS

CN 203126314 U 8/2013
CN 107232869 A * 10/2017 ..... A47C 23/055

(Continued)

OTHER PUBLICATIONS

Trans CN-107232869-A (Year: 2025).*

(Continued)

*Primary Examiner* — J. T. Newton
(74) *Attorney, Agent, or Firm* — COOPER LEGAL GROUP LLC

(57) ABSTRACT

An elastic mattress for furniture includes one or more elastic modules and one or more bottom layers, the one or more elastic modules comprise a plurality of pre-compressed springs, middle parts of the plurality of pre-compressed springs are disposed with connecting members, adjacent pre-compressed springs of the plurality of pre-compressed springs are connected to each other by corresponding ones of the connecting members, connecting structures of side surfaces of a corresponding one of the connecting members of the plurality of pre-compressed springs comprise one or more first connecting structures and one or more second connecting structures, the one or more first connecting structures and the one or more second connecting structures are disposed on adjacent ones of the side surfaces of the corresponding one of the connecting members, and bottom surfaces of the plurality of pre-compressed springs are connected to the one or more bottom layers.

24 Claims, 30 Drawing Sheets

(56) References Cited

U.S. PATENT DOCUMENTS

| | | | | | |
|---|---|---|---|---|---|
| 5,401,007 | A * | 3/1995 | Dabney | A47C 23/005 | 5/255 |
| 5,787,533 | A * | 8/1998 | Fromme | A47C 23/002 | 5/255 |
| 6,427,990 | B1 * | 8/2002 | Hartmann | A47C 27/065 | 5/255 |
| 6,826,791 | B2 * | 12/2004 | Fromme | A47C 23/002 | 5/255 |
| 8,185,988 | B2 * | 5/2012 | Wieland | A47C 23/05 | 5/247 |
| 11,889,926 | B1 * | 2/2024 | Leng | A47C 23/0438 | |
| D1,091,195 | S * | 9/2025 | Leng | D6/606 | |
| D1,091,196 | S * | 9/2025 | Leng | D6/606 | |
| D1,099,586 | S * | 10/2025 | Leng | D6/606 | |
| 12,440,039 | B2 * | 10/2025 | Leng | A47C 27/064 | |
| 2008/0128965 | A1 * | 6/2008 | Bock | A47C 27/07 | 267/101 |
| 2023/0200553 | A1 * | 6/2023 | Leng | A47C 31/105 | 5/720 |
| 2024/0398129 | A1 * | 12/2024 | Leng | A47C 27/001 | |
| 2024/0423382 | A1 * | 12/2024 | Leng | A47C 27/07 | |
| 2025/0024959 | A1 * | 1/2025 | Leng | A47C 23/002 | |
| 2025/0194810 | A1 * | 6/2025 | Leng | A47C 27/063 | |
| 2025/0194811 | A1 * | 6/2025 | Leng | A47C 27/0453 | |
| 2025/0194814 | A1 * | 6/2025 | Leng | A47C 27/063 | |
| 2025/0194816 | A1 * | 6/2025 | Nygren | A47C 27/064 | |
| 2025/0194817 | A1 * | 6/2025 | Leng | A47C 23/002 | |
| 2025/0194818 | A1 * | 6/2025 | Leng | A47C 27/064 | |
| 2025/0194819 | A1 * | 6/2025 | Leng | A47C 23/005 | |
| 2025/0198475 | A1 * | 6/2025 | Leng | A47C 27/064 | |
| 2025/0248535 | A1 * | 8/2025 | Leng | A47C 27/07 | |
| 2025/0261765 | A1 * | 8/2025 | Leng | A47C 23/002 | |
| 2025/0288122 | A1 * | 9/2025 | Leng | A47C 27/07 | |
| 2025/0302207 | A1 * | 10/2025 | Leng | A47C 27/065 | |
| 2025/0331652 | A1 * | 10/2025 | Leng | A47C 27/07 | |
| 2025/0331653 | A1 * | 10/2025 | Leng | A47C 27/065 | |

FOREIGN PATENT DOCUMENTS

| | | | | | |
|---|---|---|---|---|---|
| CN | 206785904 | U | * 12/2017 | | |
| CN | 208573302 | U | 3/2019 | | |
| CN | 209915520 | U | 1/2020 | | |
| CN | 111616552 | A | * 9/2020 | A47C 27/062 | |
| CN | 217176075 | U | 8/2022 | | |
| CN | 115670171 | A | 2/2023 | | |
| DE | 202011002660 | U1 | * 6/2011 | A47C 23/002 | |
| JP | 3306703 | B2 | * 7/2002 | A47C 23/002 | |
| KR | 20230019729 | A | 2/2023 | | |
| TW | M619081 | U | 11/2021 | | |
| WO | 2016148594 | A1 | 9/2016 | | |
| WO | 2023029873 | A1 | 3/2023 | | |
| WO | 2023098892 | A1 | 6/2023 | | |
| WO | WO-2025124452 | A1 | * 6/2025 | A47C 27/07 | |
| WO | WO-2025124517 | A1 | * 6/2025 | F16F 3/04 | |

OTHER PUBLICATIONS

Trans CN-111616552-A (Year: 2025).*
Trans CN-206785904-U (Year: 2025).*
Trans DE-202011002660-U1 (Year: 2025).*
Trans JP-3306703-B2 (Year: 2025).*
Trans WO_2025124452 (Year: 2025).*
Trans WO_2025124517 (Year: 2025).*
EP Office Action cited in EP24195697.8, mailed Feb. 28, 2025, 5 pages.
EP Search Report cited in EP24195697.8, mailed Feb. 18, 2025, 4 pages.
EP Notice of Grant cited in EP24195697.8 mailed Nov. 14, 2025, 7 pages.
International Search Report cited in PCT/CN2024/137655, mailed Mar. 5, 2025, 8 pages.
Written Opinion cited in PCT/CN2024/137655, mailed Mar. 5, 2025, 7 pages.

* cited by examiner

ELASTIC MATTRESS FOR FURNITURE

RELATED APPLICATIONS

This application claims priority to Chinese patent application number 202311720549.3, filed on Dec. 14, 2023. Chinese patent application number 202311720549.3 is incorporated herein by reference.

FIELD OF THE DISCLOSURE

The present disclosure relates to the field of furniture, and specially relates to an elastic mattress for furniture.

BACKGROUND OF THE DISCLOSURE

Bed mattresses are essential furniture in beddings for human use in modern life. Elastic bed mattresses with a middle part having elastic components are becoming increasingly popular for relaxation during sleep with increasing pressure in human lives. A soft cushion, elastic components, and a base of the existing elastic bed mattresses having the elastic components are usually integrated to form a whole structure. Upper ends of springs are connected together, causing surrounding elastic components to be simultaneously compressed when a local force is applied to the elastic mattress. Therefore, the existing elastic mattress cannot adjust a range of the force applied to the elastic components following a body posture on the elastic mattress. Additionally, the elastic mattress cannot adjust the force applied to the elastic mattress according to a sleeping posture of a person to enable the elastic mattress to conform a curve of a human body to be softer and more comfortable. In addition, after a long-time of use, the elasticity of the springs may change, and bacteria and mites breed on the elastic mattress. The soft cushion and the base of the elastic mattress are integrated with the elastic components, so it has difficult to judge a usage state and a wear level of the elastic mattress during usage, and it is impossible to clean and replace components of the elastic mattress, such as the soft cushion, the elastic components, and the base, according to the usage state and the wear level, so as to maintain comfort and softness of the elastic mattress.

BRIEF SUMMARY OF THE DISCLOSURE

The main technical problem to be solved by the present disclosure is to provide an elastic mattress for furniture. A force applied to a plurality of elastic members can be adjusted according to a body posture, allowing the elastic mattress to conform a body curve, thus enabling the elastic mattress to be more ergonomic, soft, and comfortable.

In order to solve the aforementioned technical problems, the present disclosure provides an elastic mattress for furniture, the elastic mattress for furniture comprises one or more elastic modules, and one or more bottom layers disposed below the one or more elastic modules, the one or more elastic modules comprise a plurality of elastic members, middle parts of the plurality of elastic members are disposed with connecting members, adjacent elastic members of the plurality of elastic members are connected to each other by corresponding ones of the connecting members, connecting structures of side surfaces of a corresponding one of the connecting members of the plurality of elastic members comprise one or more first connecting structures and one or more second connecting structures, the one or more first connecting structures and the one or more second connecting structures are disposed on different ones of the side surfaces of the corresponding one of the connecting members, and bottom surfaces of the plurality of elastic members are connected to the one or more bottom layers.

In some embodiments, the connecting members comprise connecting seats, the connecting seats are sleeved on the middle parts of the plurality of elastic members, each of the connecting seats comprises one or more insertion members as the one or more first connecting structures, each of the connecting seats comprises one or more insertion sockets as the one or more second connecting structures, and a male and female connection of a first one of the one or more insertion members on a first one of the plurality of elastic members and a first one of the one or more insertion sockets on a second one of the plurality of elastic members achieves a connection between the plurality of elastic members.

In some embodiments, each of the connecting seats comprises four side surfaces, the one or more insertion members comprises two or more insertion members, the one or more insertion sockets comprises two or more insertion sockets, a first one of the two or more insertion members and a first one of the two or more insertion sockets are respectively disposed on two first opposite side surfaces of the four side surfaces of each of the connecting seats, and a second one of the two or more insertion members and a second one of the two or more insertion sockets are respectively disposed on two second opposite side surfaces of the four side surfaces of each of the connecting seats, or each of the connecting seats comprises four side surfaces, the two or more insertion members are disposed on two first opposite side surfaces of the four side surfaces of each of the connecting seats, and the two or more insertion sockets are disposed on two second opposite side surfaces of the four side surfaces of each of the connecting seats.

In some embodiments, the two or more insertion members comprise one or more positioning structures configured to be positioned to and cooperate with one or more side walls of the two or more insertion sockets, the one or more positioning structures have elasticity, the one or more side walls of the two or more insertion sockets corresponding to the one or more positioning structures are disposed with one or more releasing members configured to be pushed to move the one or more positioning structures through the elasticity of the one or more positioning structures, and the one or more releasing members are configured to be pressed to enable the one or more positioning structures to be separated from the two or more insertion sockets to achieve a disassembly of the plurality of elastic members.

In some embodiments, the one or more positioning structures comprise one or more protrusions disposed on upper sides of the two or more insertion members, and one or more upper side walls of the two or more insertion sockets comprise one or more spaces in which the one or more protrusions are clamped to enable the one or more positioning structures to be positioned to and cooperate with the two or more insertion sockets.

In some embodiments, the one or more positioning structures comprise one or more protrusions disposed on two sides or a single side of the two or more insertion members, and the one or more releasing members and the one or more side walls of the two or more insertion sockets form one or more spaces in which the one or more protrusions are clamped to enable the one or more positioning structures to be positioned to and cooperate with the two or more insertion sockets.

In some embodiments, the two or more insertion members comprise one or more T-shaped protrusions, the two or more insertion sockets comprise one or more holes, one or more push buttons configured to move up and down in a vertical direction are sleeved on an outer side of the one or more holes, the one or more push buttons comprise one or more buckling holes corresponding to the one or more holes, the one or more push buttons comprise one or more positioning holes having a diameter smaller than a diameter of the one or more buckling holes and disposed above the one or more buckling holes, a first one of the one or more T-shaped protrusions on a first one of the connecting members of the plurality of elastic members passes through a first one of the one or more buckling holes on a second one of the connecting members of the plurality of elastic members to be clamped in a first one of the one or more holes on the second one of the plurality of elastic members, and the one or more push buttons are pressed to enable the one or more T-shaped protrusions to be locked by the one or more positioning holes, so as to achieve a mutual connection between the plurality of elastic members.

In some embodiments, the two or more insertion members comprise one or more protrusions, the two or more insertion sockets comprise one or more grooves, one or more knobs are sleeved on outer sides of the one or more grooves, the one or more knobs comprise one or more spaces in which the one or more protrusions are clamped to the one or more grooves, the one or more protrusions are clamped to the one or more grooves, and the one or more knobs rotate to enable the one or more protrusions to be locked to achieve a mutual connection between the plurality of elastic members.

In some embodiments, the one or more elastic modules comprise a plurality of elastic modules, and one or more peripheral elastic members of the plurality of elastic members on a first one of the plurality of elastic modules and one or more peripheral elastic members of the plurality of elastic members on a second one of the plurality of elastic modules are connected together using one or more lap joints or corresponding ones of the connecting members.

In some embodiments, each of the connecting seats comprises two or more connecting seat components, and the two or more connecting seat components are detachably buckled to a corresponding one of the plurality of elastic members.

In some embodiments, the two or more connecting seat components of each of the connecting seats are buckled together.

In some embodiments, the two or more connecting seat of each of the connecting seats components are connected together through a corresponding one of the two or more insertion members and a corresponding one of the two or more insertion sockets.

In some embodiments, the elastic mattress for furniture further comprises an upper cushion layer, the upper cushion layer is disposed above a corresponding one of the one or more elastic modules, or the upper cushion layer covers an upper side and a periphery of the corresponding one of the one or more elastic modules.

In a preferred embodiment, the elastic mattress for furniture further comprises an upper cushion layer, and the upper cushion layer is detachably connected to one or more outermost elastic members of the plurality of elastic members on the corresponding one of the one or more elastic modules.

In some embodiments, the upper cushion layer is detachably connected to one or more outermost elastic members of the plurality of elastic members on the corresponding one of the one or more elastic modules.

In some embodiments, a periphery of the upper cushion layer comprises a plurality of strips having pull buckles, and the plurality of strips having pull buckles are connected to corresponding ones of the connecting members on peripheral elastic members of the plurality of elastic members.

In some embodiments, the upper cushion layer is an integrated upper cushion layer, or the upper cushion layer is formed by a combination of a plurality of cushion layers with different hardness.

In some embodiments, each of the one or more bottom layers is an integrated structure, or each of the one or more bottom layers comprises a plurality of bottom layer units detachably spliced together.

In some embodiments, the one or more bottom layers is a plurality of bottom layers, and the plurality of bottom layers are detachably spliced together to form a base for the elastic mattress.

In some embodiments, the plurality of bottom layers are connected together through third members, or the plurality of bottom layer units are connected together through the third members.

In some embodiments, the third members are connecting knobs, a bottom of each of the connecting knobs comprises two T-shaped buckling pins symmetrical to each other, a periphery of each of the plurality of bottom layer units or a periphery of each of the plurality of bottom layers comprises sliding rails, each of the sliding rails is configured to be connected to the two T-shaped buckling pins of a corresponding one of the connecting knobs, the sliding rails narrow along a rotation direction of the connecting knobs, the two T-shaped buckling pins of each of the connecting knobs are respectively buckled to a wide part of a corresponding one of the sliding rails on a first bottom layer unit of the plurality of bottom layer units or a first bottom layer of the plurality of bottom layers and a wide part of a corresponding one of the sliding rails on a second bottom layer unit of the plurality of bottom layer units adjacent to the first bottom layer unit or a second bottom layer of the plurality of bottom layers adjacent to the first bottom layer, and each of the connecting knobs rotates to enable the two T-shaped buckling pins to be positioned to a narrow part of the corresponding one of the sliding rails on the first bottom layer unit or the first bottom layer and a narrow part of the corresponding one of the sliding rails on the second bottom layer unit or the second bottom layer, so as to achieve a connection between the first bottom layer unit and second bottom layer unit or a connection between the first bottom layer and second bottom layer.

In some embodiments, the plurality of elastic members are connected to the one or more bottom layers through fixing members.

In some embodiments, at least part of each of the one or more bottom layers is disposed with the fixing members.

In some embodiments, the fixing members are a plurality of positioning protrusions disposed on the plurality of bottom layer units, lower end surfaces of the plurality of elastic members comprise a plurality of cavities configured to be positioned to and cooperate with the plurality of positioning protrusions, and the plurality of elastic members are connected to the one or more bottom layers by a plug-in connection between the plurality of positioning protrusions and the plurality of cavities.

In some embodiments, the one or more bottom layers are rigid substrates or flexible substrates.

In some embodiments, the plurality of elastic members are compressed to a locked state.

In some embodiments, each of the plurality of elastic members comprises a top cover and a bottom cover, positioning structures are disposed between the top cover and the bottom cover, and the top cover and the bottom cover are buckled to each other through the positioning structures to enable each of the plurality of elastic members to be compressed to the locked state.

In some embodiments, the positioning structures are divided into a first positioning structure and a second positioning structure, the first positioning structure is disposed on a lower end surface of the top cover, the second positioning structure is disposed on an upper end surface of the bottom cover, the first positioning structure and the second positioning structure are detachably buckled to each other, when the first positioning structure and the second positioning structure are buckled to each other, each of the plurality of elastic members is compressed, and when the first positioning structure and the second positioning structure are detached from each other, each of the plurality of elastic members is released.

In some embodiments, a lower end surface of the bottom cover of each of the plurality of elastic members comprises a cavity, and the bottom cover defines a top surface of the cavity.

In some embodiments, the second positioning structure is discontinuous flanges disposed on the top surface of the cavity.

The present disclosure further provides a method for applying the elastic mattress for furniture, applying the elastic mattress for furniture in a sofa, a bed mattress, or a soft stool.

Compared with the existing techniques, the technical solution has the following advantages.

1. In the elastic mattress of the present disclosure, upper ends of the plurality of elastic members of the one or more elastic modules are independent, so that a force applied to the plurality of elastic members of the elastic mattress can conform to a body curve according to a human body posture to enable the elastic mattress to be softer and more comfortable.

2. In the elastic mattress of the present disclosure, the upper cushion layer and the one or more elastic modules are detachably connected together and the upper cushion layer is disposed above the one or more elastic modules. A usage state of the elastic mattress can be judged in a process of using the elastic mattress, so that the elastic mattress can be cleaned and replaced in time.

3. In the elastic mattress of the present disclosure, the plurality of elastic members can be compressed to the locked state. In transportation or relocation of the elastic mattress, the detached plurality of elastic members can be compressed to save transportation space and to facilitate the relocation.

DETAILED DESCRIPTION OF THE EMBODIMENTS

Figure 1:
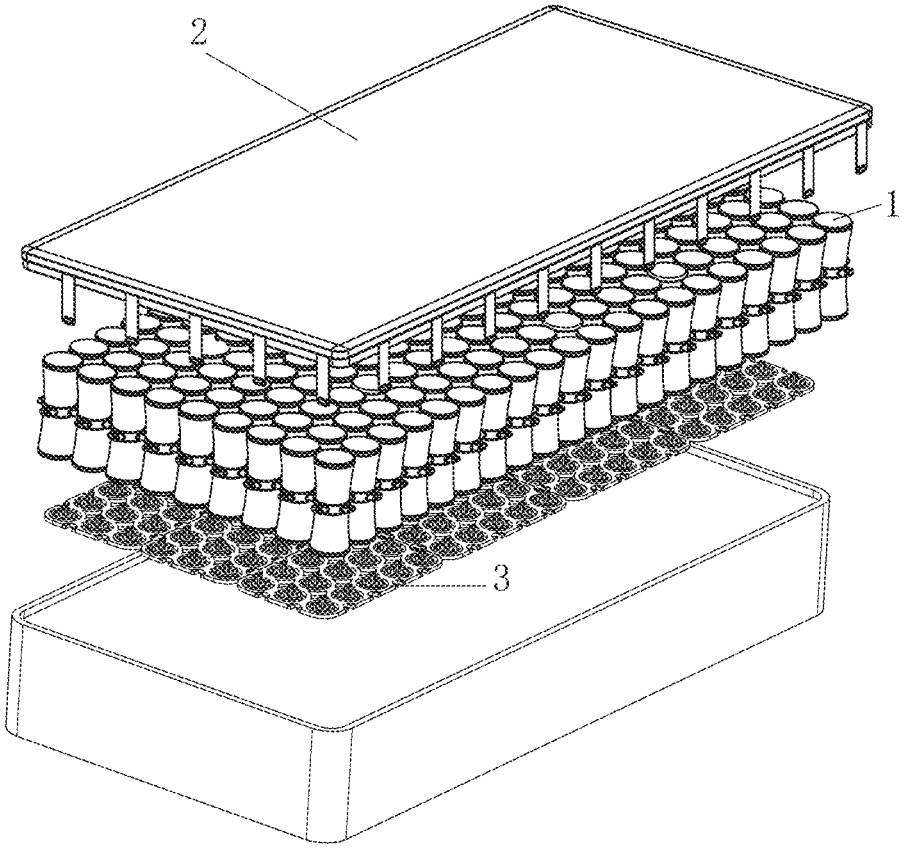
FIG. 1 shows a diagrammatic view of an elastic mattress.
Figure 2:
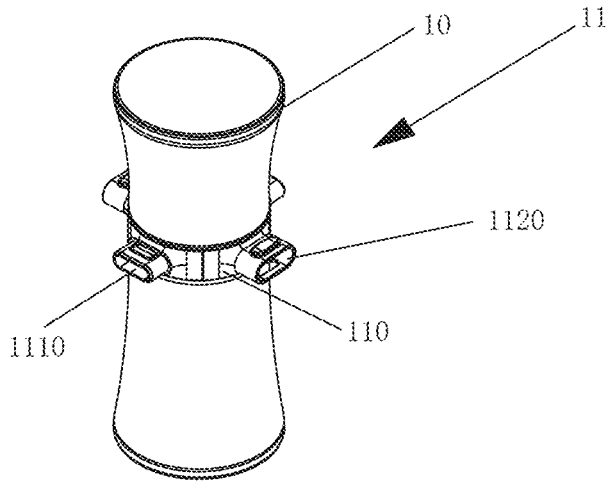
FIG. 2 shows a diagrammatic view of an elastic member in Embodiment 1.
Figure 3:
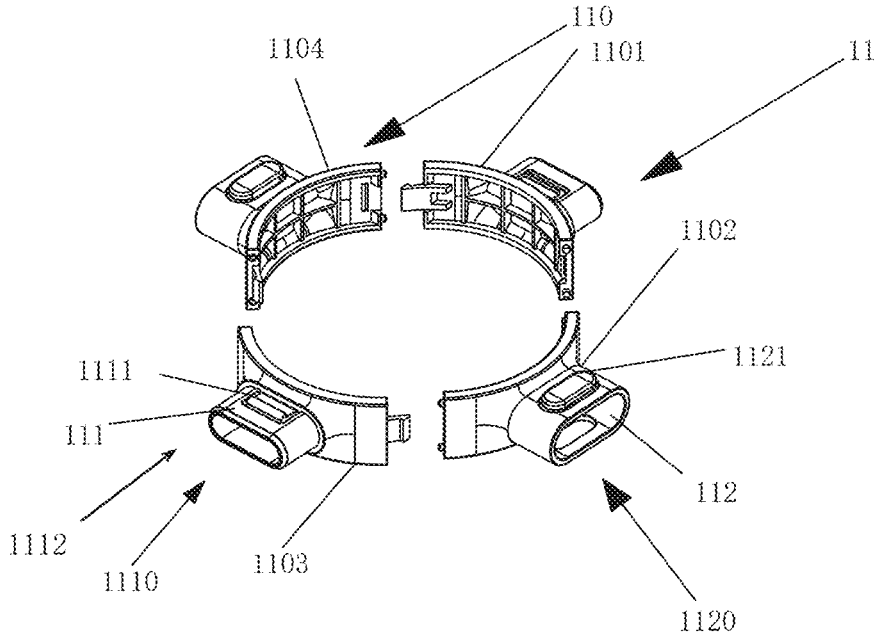
FIG. 3 shows a diagrammatic view of a connecting member in Embodiment 1.
Figure 4:
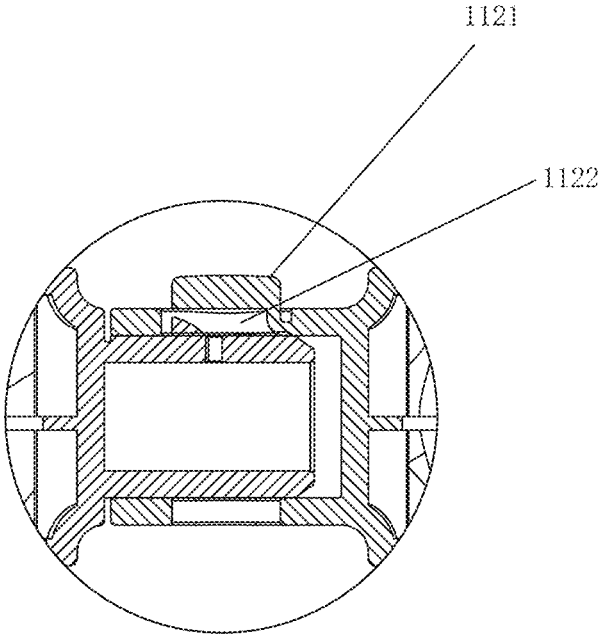
FIG. 4 shows a cross-sectional view of a plug-in arrangement of the connecting member in Embodiment 1.
Figure 5:
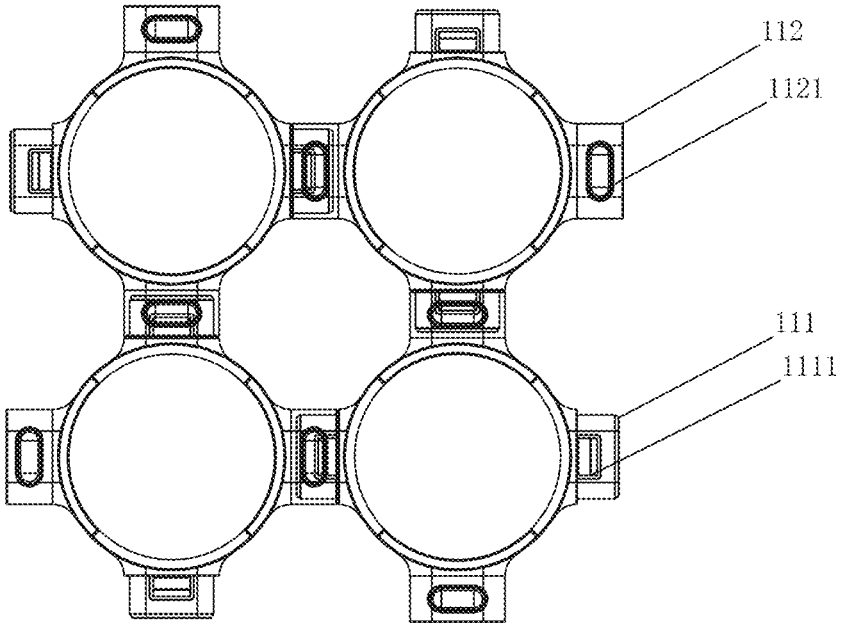
FIG. 5 shows a diagrammatic view of a connection relation in Embodiment 1.
Figure 6:
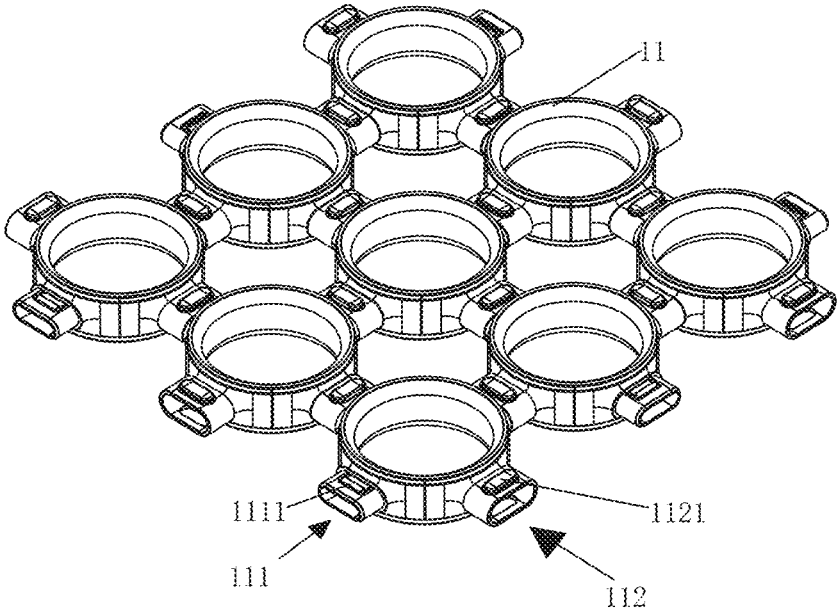
FIG. 6 shows a diagrammatic view of a graphical object of the connection relation in Embodiment 1.
Figure 7:
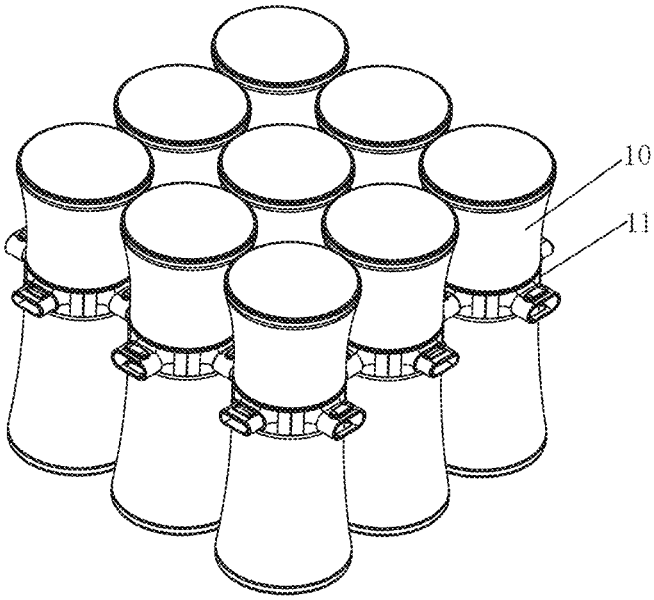
FIG. 7 shows a diagrammatic view of a graphical object of an elastic module in Embodiment 1.
Figure 8:
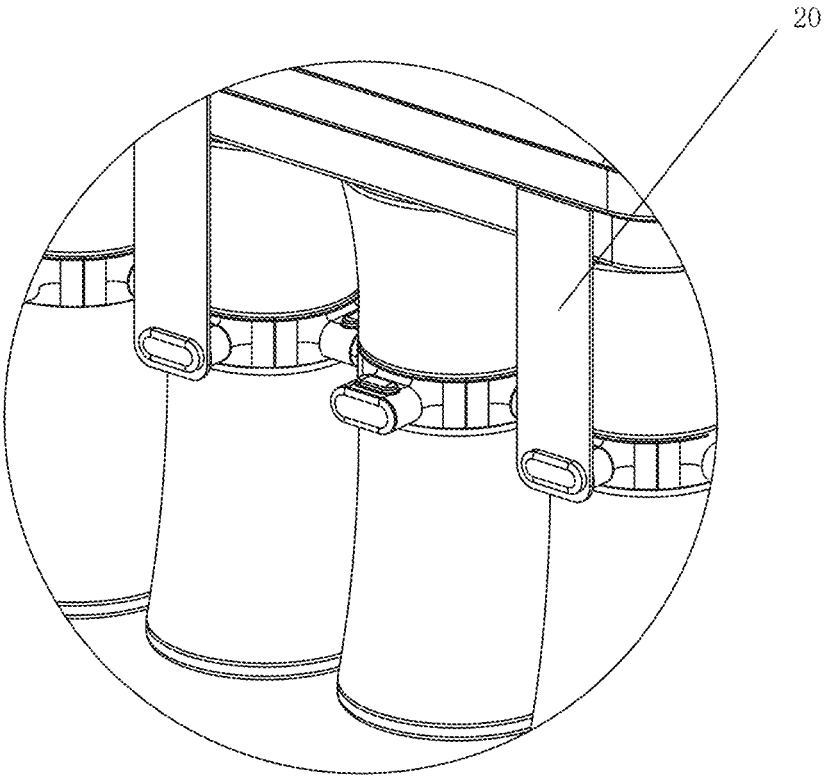
FIG. 8 shows a diagrammatic view of a strip with a pull buckle connected to the elastic module in Embodiment 1.
Figure 9:
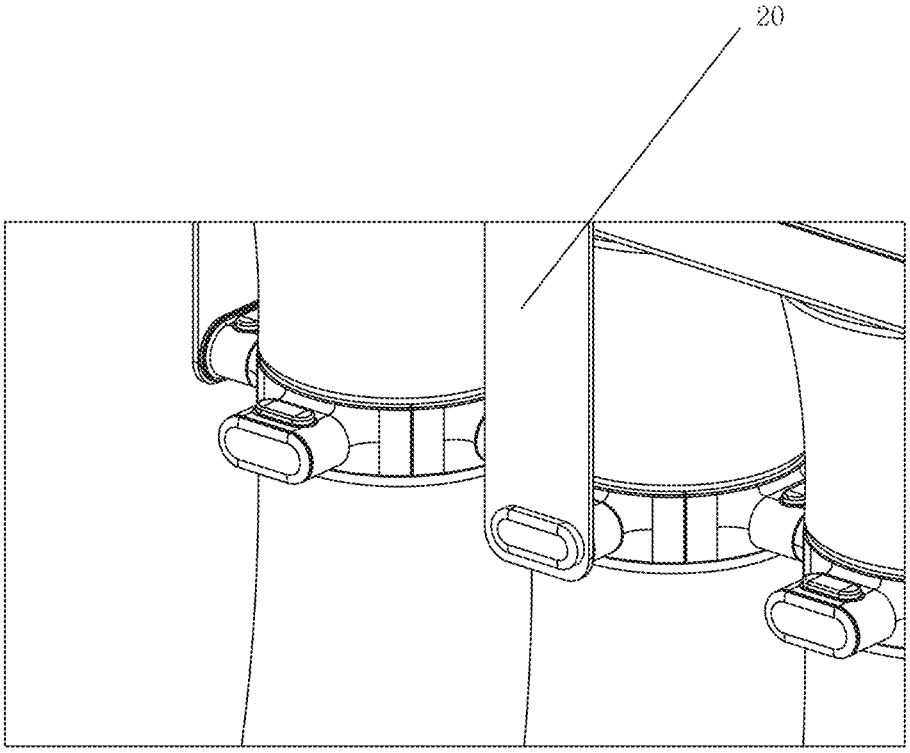
FIG. 9 shows a diagrammatic view of a graphical object of the strip with the pull buckle connected to the elastic module in Embodiment 1.
Figure 10:
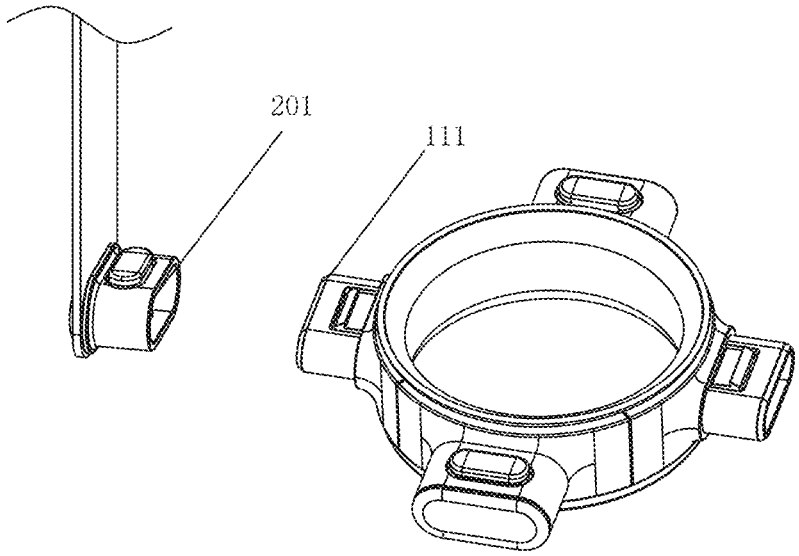
FIG. 10 shows a diagrammatic view of the strip with the pull buckle and the connecting member in Embodiment 1.
Figure 11:
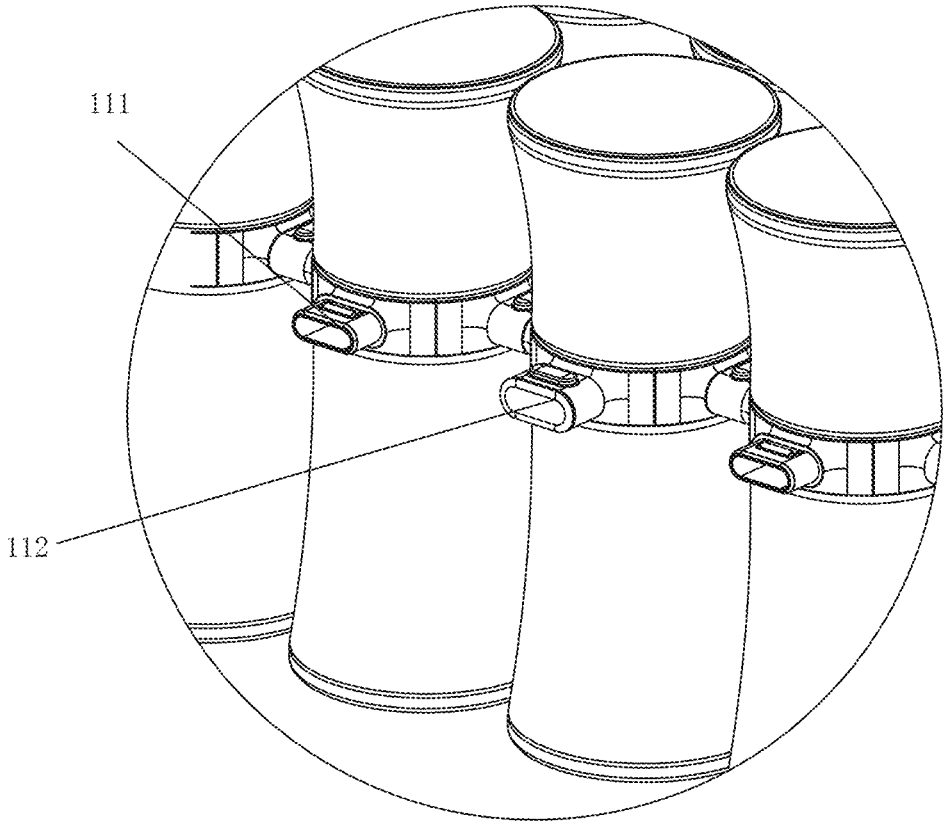
FIG. 11 shows a diagrammatic view of one or more peripheral elastic members of the elastic module in Embodiment 1.
Figure 12:
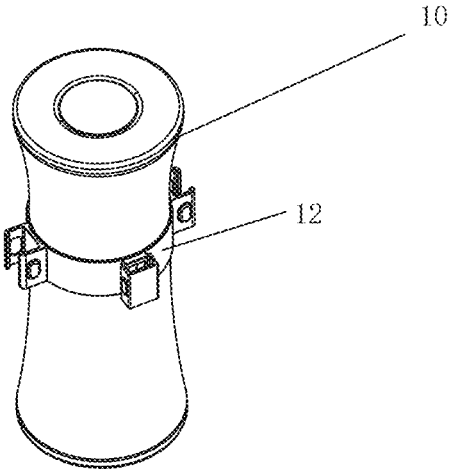
FIG. 12 shows a diagrammatic view of an elastic member in Embodiment 2.
Figure 13:
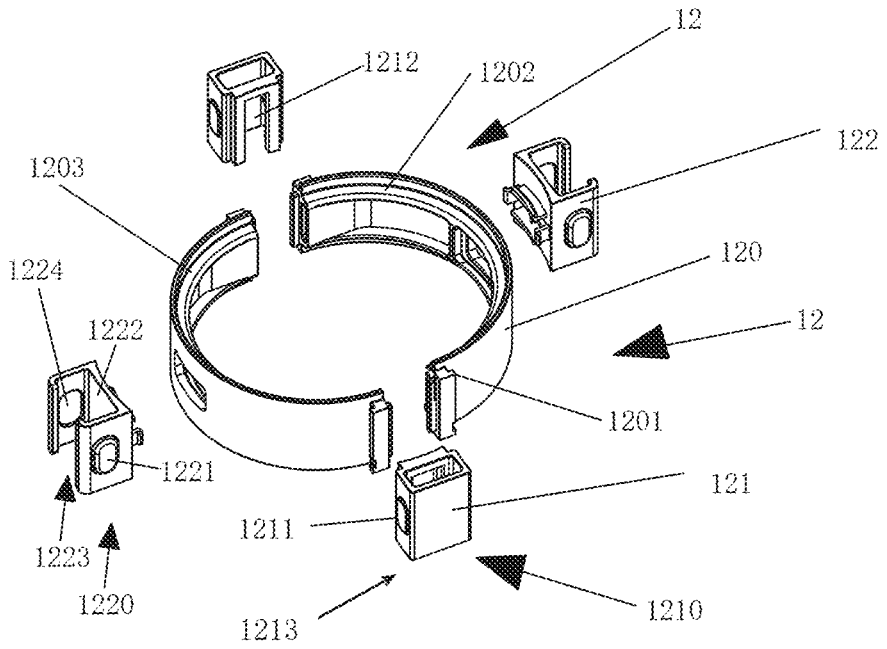
FIG. 13 shows a diagrammatic view of a connecting member in Embodiment 2.
Figure 14:
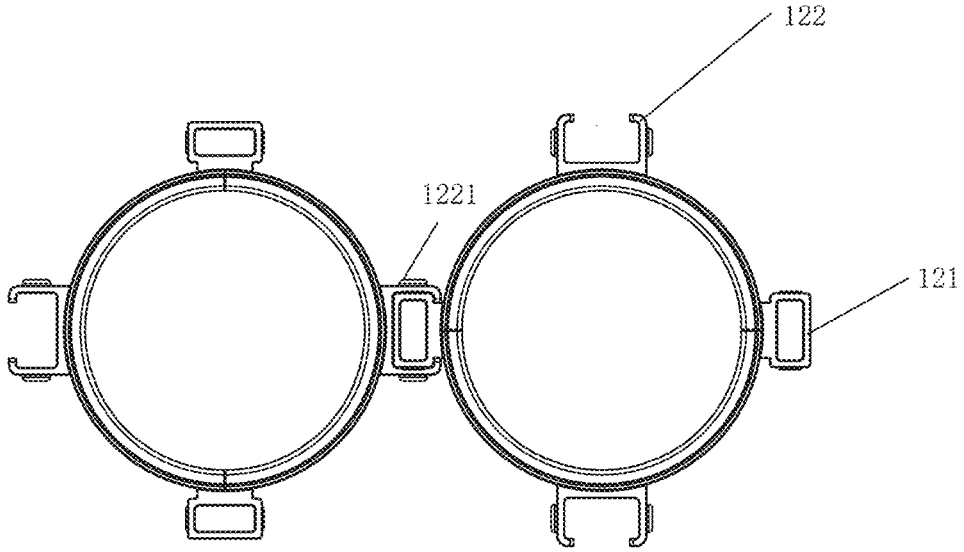
FIG. 14 shows a diagrammatic view of a plug-in connection relation in Embodiment 2.
Figure 15:
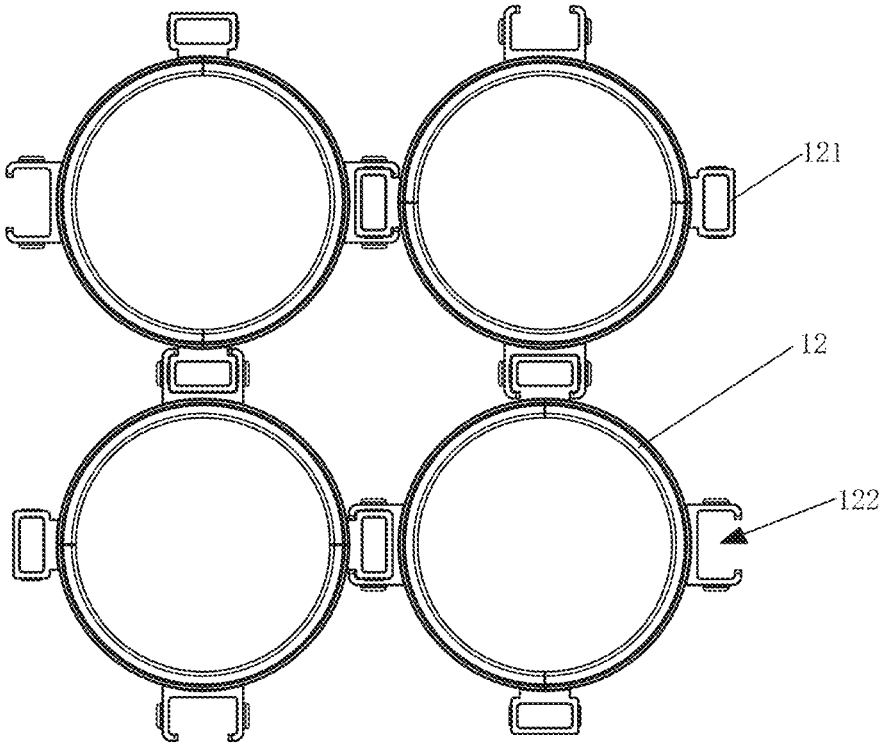
FIG. 15 shows a diagrammatic view of a virtual object of a connection relation in Embodiment 2.
Figure 16:
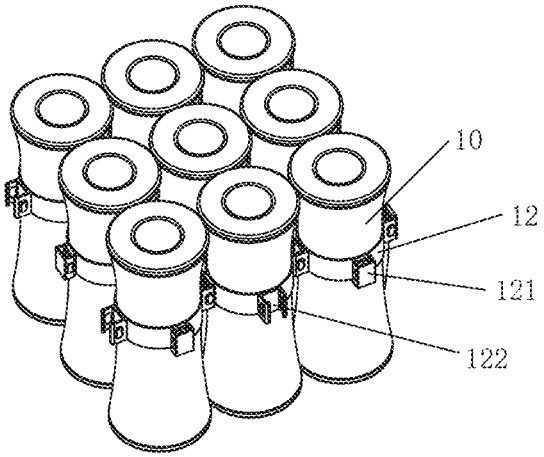
FIG. 16 shows a diagrammatic view of a graphical object of an elastic module in Embodiment 2.
Figure 17:
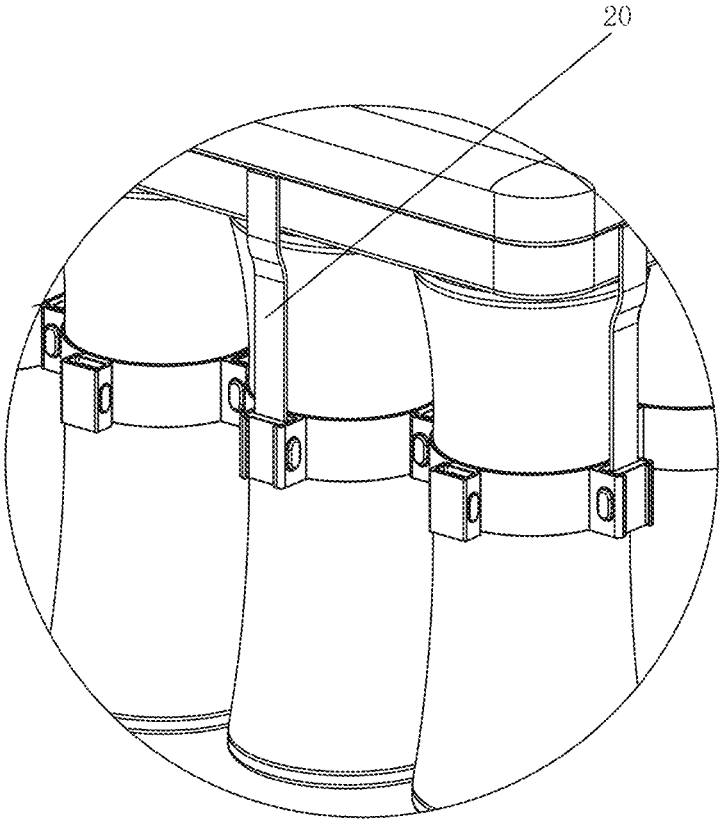
FIG. 17 shows a diagrammatic view of a strip with a pull buckle connected to the elastic module in Embodiment 2.
Figure 18:
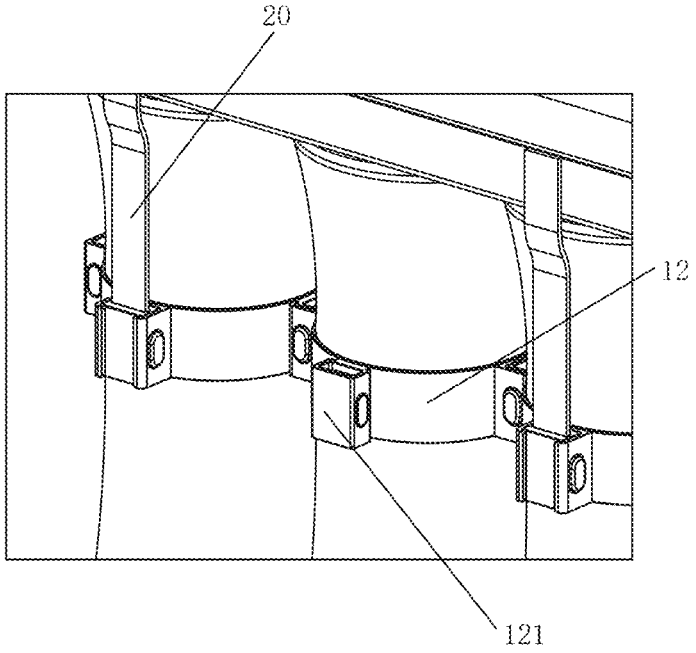
FIG. 18 shows a diagrammatic view of a graphical object of the strip with the pull buckle connected to the elastic module in Embodiment 2.
Figure 19:
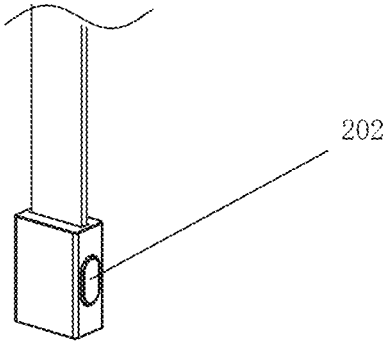
FIG. 19 shows a diagrammatic view of the strip with the pull buckle in Embodiment 2.
Figure 20:
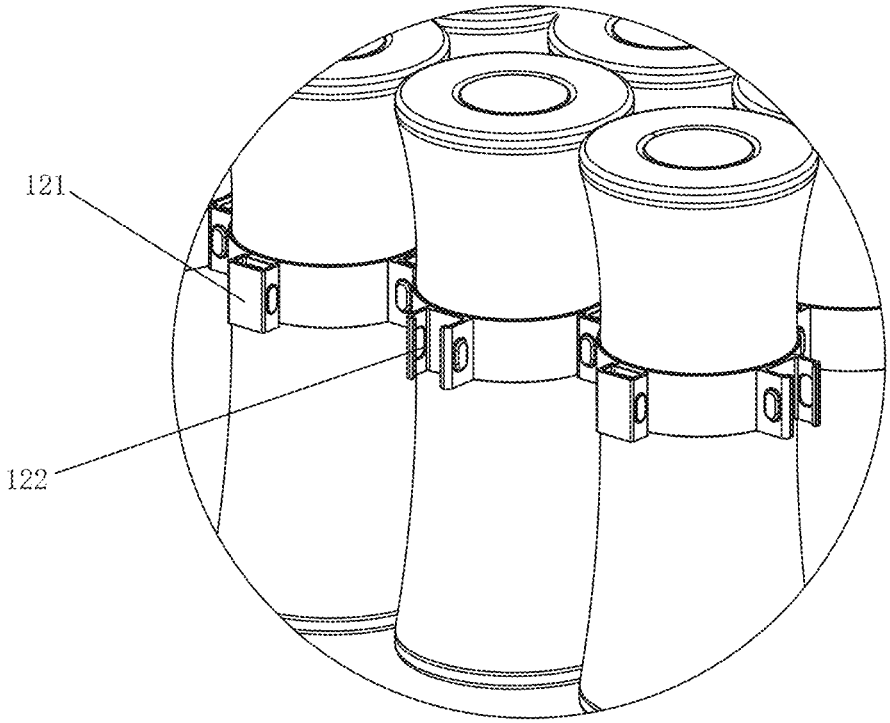
FIG. 20 shows a diagrammatic view of one or more peripheral elastic members of the elastic module in Embodiment 2.
Figure 21:
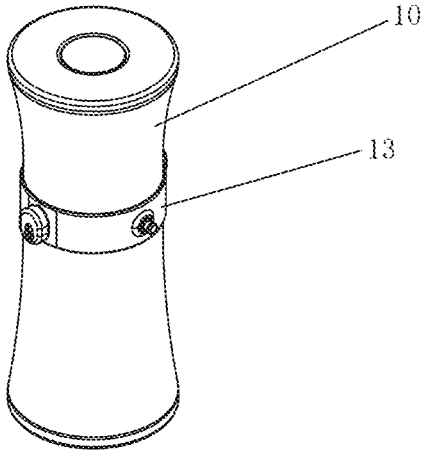
FIG. 21 shows a diagrammatic view of an elastic member in Embodiment 3.
Figure 22:
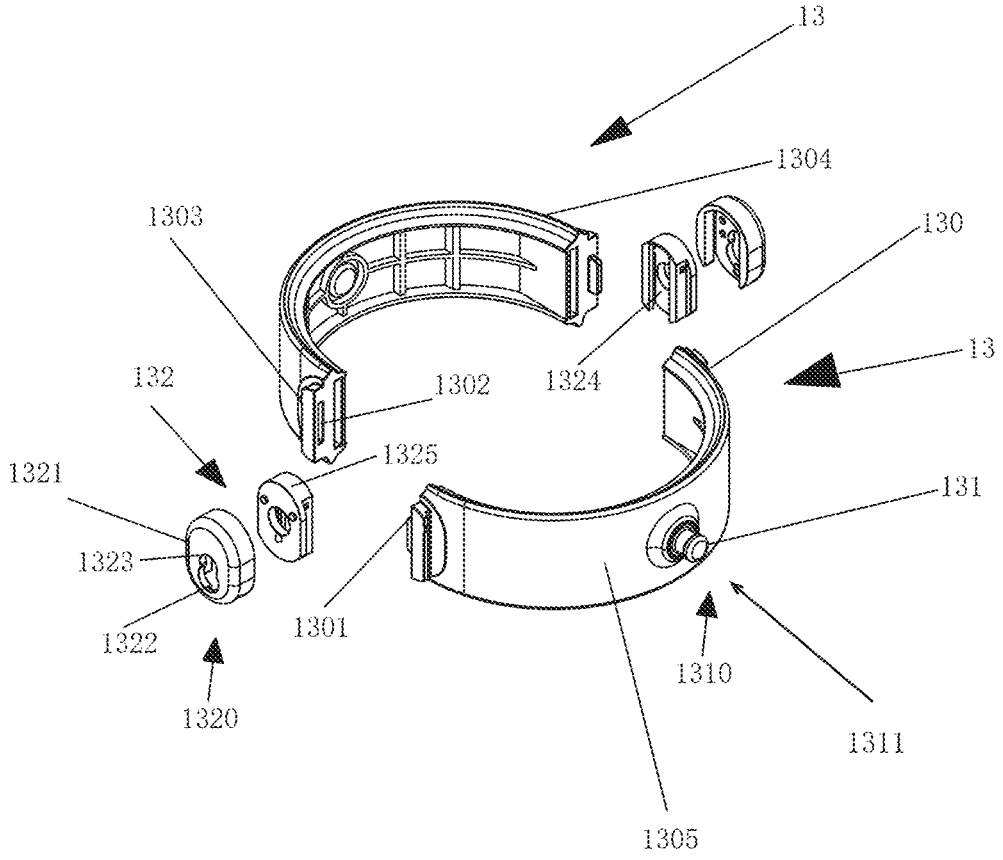
FIG. 22 shows a diagrammatic view of a connecting member in Embodiment 3.
Figure 23:
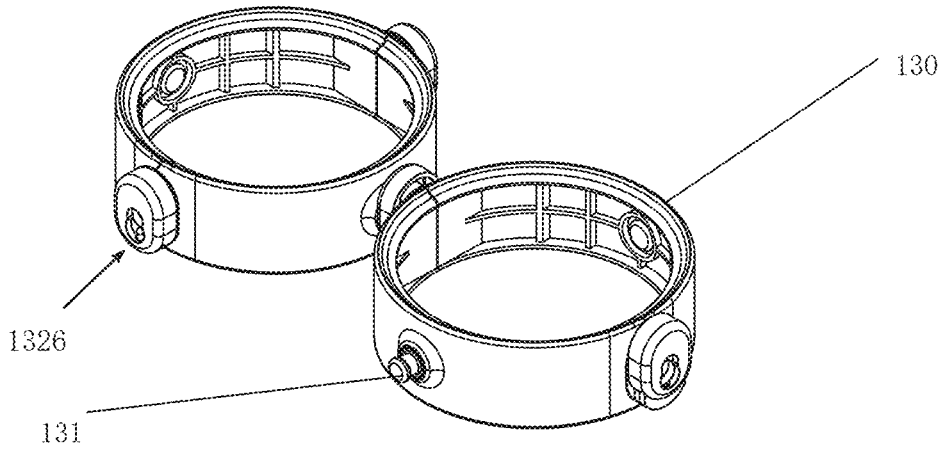
FIG. 23 shows a diagrammatic view of a plug-in arrangement in Embodiment 3.
Figure 24:
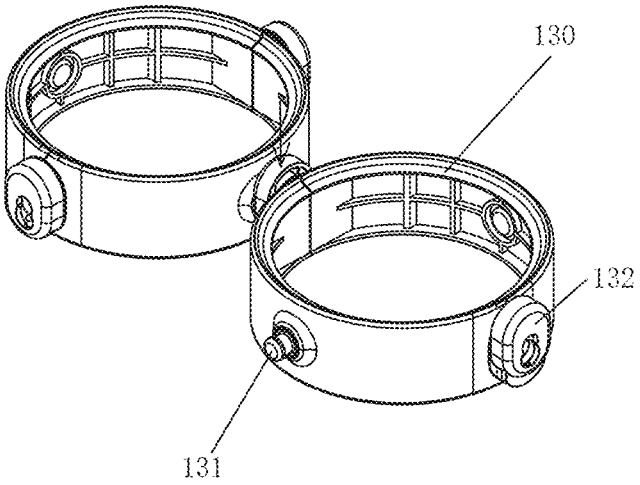
FIG. 24 shows a diagrammatic view of a graphical object of a protrusion plugged into a hole in Embodiment 3.

The technical solutions in the embodiments of the present disclosure will be clearly and completely described below in combination with the accompanying drawings in the embodiments of the present disclosure. It is obvious that the described embodiments are preferred embodiments of the present disclosure and should not be understood as an exclusion of other embodiments. All other embodiments fall within the protection scope of the present disclosure provided that they are made by a person of ordinary technical skill in the art based on the embodiments of the present disclosure without creative works.

Embodiment 1

Referring to FIGS. 1-11, this embodiment provides an elastic mattress for furniture, the elastic mattress comprises a plurality of elastic modules 1, an upper cushion layer 2 disposed above a corresponding one of the plurality of elastic modules 1, and a bottom layer 3 disposed below a corresponding one of the plurality of elastic modules 1 for fixing the corresponding one of the plurality of elastic modules 1. Each of the plurality of elastic modules 1 comprises a plurality of elastic members 10. Middle parts of the plurality of elastic members 10 are disposed with connecting members 11, and adjacent elastic members 10 of the plurality of elastic members 10 are connected to each other by the connecting members 11. Connecting structures of all sides of each of the connecting members 11 are divided into one or more first connecting structures 1110 and one or more second connecting structures 1120, and the one or more first connecting structures 1110 and the one or more second connecting structures 1120 are adjacently disposed on different sides of a corresponding one of the connecting members 11. The plurality of elastic members 10 are connected to the bottom layer 3.

More specifically, in this embodiment, each of the connecting members 11 comprises a connecting seat 110, and the connecting seat 110 can be divided into four detachable connecting seat components 1101, 1102, 1103, and 1104. The four detachable connecting seat components 1101, 1102, 1103, and 1104 are buckled together to form a corresponding ring-shaped one of the connecting members 11 to be buckled to the middle part of a corresponding one of the plurality of elastic members 10. Insertion members 111 are disposed on two first opposite sides of the connecting seat 110 as the one or more first connecting structures 1110, and insertion sockets 112 are disposed on two second opposite sides of the connecting seat 110 as the one or more second connecting structures 1120. A protrusion 1111 is disposed on an upper side of each of the insertion members 111 as a positioning structure 1112, and an upper wall of a corresponding one of the insertion sockets 112 comprises a space 1122 for receiving the protrusion 1111. When each of the insertion members 111 is disposed in the corresponding one of the insertion sockets 112, the protrusion 1111 is buckled to the space 1122, and a positioning cooperation between a corresponding one of the insertion members 111 and the corresponding one of the insertion sockets 112 achieves a connection between the elastic members 10.

The protrusion 1111, as the positioning structure 1112, has elasticity. A position of the upper wall of each of the insertion sockets 112 corresponding to the protrusion 1111 is disposed with a releasing member 1121 configured to be pushed to move the protrusion 1111 through the elasticity of the protrusion 1111. The releasing member 1121 is pressed to drive the protrusion 1111 to be separated from the space of the upper wall of the corresponding one of the insertion sockets 112 to disengage the positioning cooperation between the corresponding one of the insertion members 111 and the corresponding one of the insertion sockets 112 to detach the elastic members 10 from each other.

When the plurality of elastic members 10 are connected together, one of the insertion members 111 on a first one of the plurality of elastic members 10 is disposed in one of the insertion sockets 112 of a second one of the plurality of elastic members 10 adjacent to the first one of the plurality of elastic members, and the protrusion 1111 is buckled to the space 1122 of the upper wall of the corresponding one of the insertion sockets 112 to achieve the connection between the plurality of elastic members 10. When the plurality of elastic members 10 are detached from each other, the releasing member 1121 is pressed to drive the protrusion 1111 to be separated from the space 1122 of the upper wall of the corresponding one of the insertion sockets to release the positioning cooperation between the corresponding one of the insertion sockets 112 and the corresponding one of the insertion members 111 to detach the plurality of elastic members 10 from each other.

In this embodiment, one or more outermost elastic members 10 of the plurality of elastic members 10 on a first one of the plurality of elastic modules 1 and one or more outermost elastic members 10 of the plurality of elastic members 10 on a second one of the plurality of elastic modules 1 are also connected together using a male-female connection between the insertion sockets 112 and the insertion members 111. As a simple alternative of this embodiment, the one or more outermost elastic members 10 of the plurality of elastic members 10 on the first one of the plurality of elastic modules 1 and the one or more outermost elastic members 10 of the plurality of elastic members 10 on the second one of the plurality of elastic modules 1 can also be connected using one or more lap joints.

In order to judge a use situation and a cleanliness of the elastic mattress in a use process and to clean the elastic mattress or replace components according to the use situation in time, in this embodiment, the upper cushion layer 2 is disposed above the corresponding one of the plurality of elastic modules 1, the plurality of elastic members 10 are exposed on an outer side of the elastic mattress, and the elastic mattress defines an open structure. This allows the user to judge the cleanliness of the elastic mattress and wear level of the plurality of elastic members 10 through naked eyes in use in real time.

In order to facilitate the user cleaning the elastic mattress and replacing the components, referring to FIGS. 8-11, in this embodiment, a periphery of the upper cushion layer 2 comprises one or more strips 20 with pull buckles. The one or more strips 20 with the pull buckles are connected to the insertion members 111 or the insertion sockets 112 of corresponding connecting members 11 of one or more outermost elastic members 10 of a corresponding one of the plurality of elastic modules 1 to achieve a detachable connection of the upper cushion layer 2 and the corresponding one of the plurality of elastic modules 1.

In this embodiment, the one or more strips 20 with the pull buckles comprise one or more grooves 201 having same structures as in the connecting members 11 and are connected to corresponding insertion members 111 on the connecting members 11. As a simple alternative of this embodiment, the one or more strips 20 with the pull buckles comprise one or more protrusions having same structures as in the connecting members 11 and are connected to corresponding insertion sockets 112 on the connecting members 11.

In this embodiment, according to different needs for softness of the elastic mattress of the user, the upper cushion layer 2 comprises a plurality of cushion layers with different softness or hardness. The user can combine cushion layers having appropriate hardness to form a suitable upper cushion layer 2 according to actual needs and preferences for softness of the upper cushion layer 2. A surface of the upper cushion layer 2 can also use leather, ultrafine fiber, cotton, wool, or other materials. As a simple alternative of this embodiment, the upper cushion layer 2 can also be an integrated structure.

Referring to FIGS. 36-51, in this embodiment, the bottom layer 3 is spliced by a plurality of bottom layer units 30. In order to enable the plurality of elastic members 10 to be connected to the bottom layer 3, the bottom layer 3 comprises a plurality of positioning protrusions 31 as fixing members 311, and lower end surfaces of the plurality of elastic members 10 comprise a plurality of cavities 1022 positioned to and cooperating with the plurality of positioning protrusions 31. Therefore, the plurality of elastic members 10 are connected to the bottom layer 3 using a male-female connection of the plurality of positioning protrusions 31 and the plurality of cavities 1022.

The bottom layer 3 is spliced by connecting the plurality of bottom layer units 30 together through connecting knobs 32 (i.e., third members 320) to match a size of a corresponding one of the plurality of elastic modules 1. Each of the connecting knobs 32 is a circular knob, and a bottom of each of the circular knobs comprises two T-shaped buckling pins 321 symmetrical to each other. Edges of the plurality of bottom layer units 30 comprise sliding rails 301 configured to be positioned to and cooperate with the two T-shaped buckling pins 321 of each of the connecting knobs 32. Widths of the sliding rails 301 narrow along a rotation direction of the connecting knobs, allowing the two T-shaped buckling pins 321 of each of the connecting knobs 32 to be respectively buckled to wide parts of corresponding sliding rails 301 of two adjacent bottom layer units 30 of the plurality of bottom layer units 30. Handles on the connecting knobs 32 rotate to enable the connecting knobs 32 to rotate until the two T-shaped buckling pins 321 are positioned at narrow parts of the corresponding sliding rails 301, and a connection of the two adjacent bottom layer units 30 is achieved.

As a simple alternative of this embodiment, the bottom layer 3 can also be an integrated structure to match a size of a corresponding one of the plurality of elastic modules 1. At the same time, the plurality of elastic members 10 are connected together in each of the plurality of elastic modules 1, so that the plurality of positioning protrusions 31 can be located only on some of the bottom layer units 30 on a periphery of the bottom layer 3.

In this embodiment, the elastic mattress is spliced by the plurality of elastic modules 1, and a plurality of the bottom layers 3 connected to the plurality of elastic modules 1 are detachably connected to form a base of the elastic mattress using the connecting knobs 32. Therefore, a specific number of the plurality of elastic modules 1 and the bottom layers 3 that are detachably connected together are spliced together to form the elastic mattress according to actual size requirements of the user.

A size of each of the plurality of bottom layer units 30 can be set arbitrarily, and one of the plurality of bottom layer units 30 can be connected to one or more of the plurality of elastic members 10. The bottom layer 3 can be formed by splicing the plurality of bottom layer units 30 with different sizes together through the connecting knobs 32, or by splicing the plurality of bottom layer units 30 with same sizes together through the connecting knobs 32. As a simple alternative of this embodiment, the plurality of bottom layer units 30 and the plurality of the bottom layers 3 can also be detachably connected to each other using a plug-in method, a hinge, etc.

Specifically, the bottom layer 3 can be formed by splicing a plurality of 8-seat bottom layer units 30 and/or a plurality of 4-seat bottom layer units 30 of the plurality of bottom layer units 30 together, or by splicing a plurality of 5-seat bottom layer units 30 of the plurality of bottom layer units 30 together, or by splicing by splicing a plurality of 1-seat bottom layer units 30 and/or a plurality of 5-seat bottom layer units 30 of the plurality of bottom layer units 30 together. A seat number of the plurality of bottom layer units 30 and a combination for splicing are not limited to the description mentioned in this embodiment.

In this embodiment, the bottom layer 3 connected to the plurality of elastic members 10 comprises a rigid substrate, and the rigid substrate can be a rigid material, such as a wood board, a vacuum-formed plastic board, etc. As a simple alternative of this embodiment, the bottom layer 3 can also comprise a flexible substrate.

Figure 50:
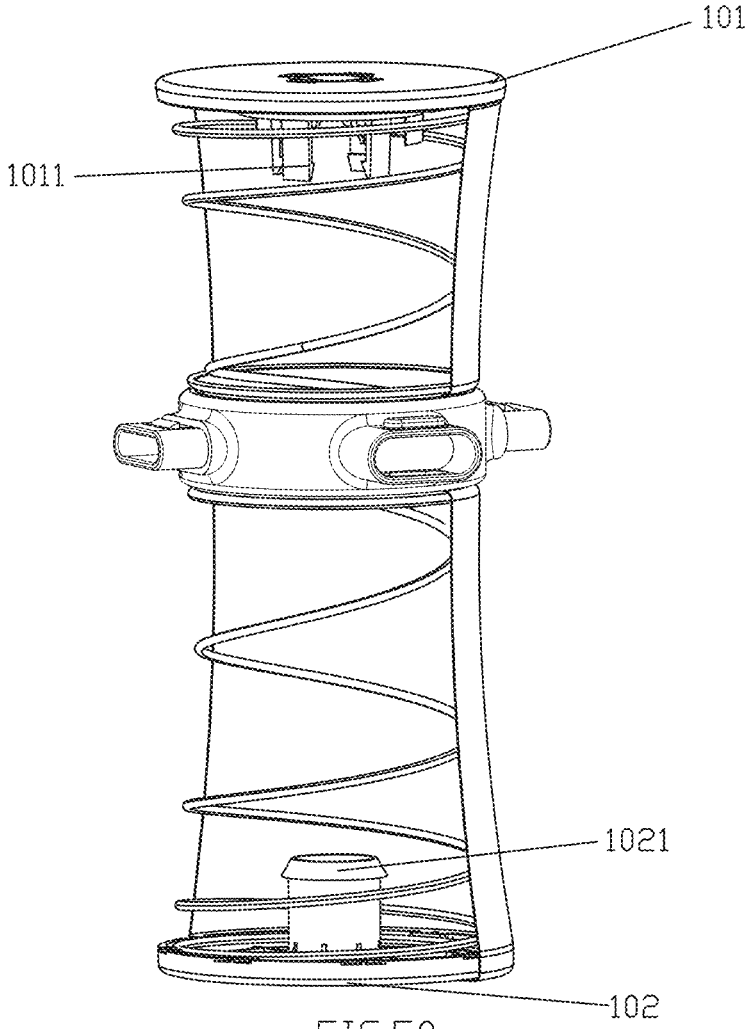
FIG. 50 shows a diagrammatic view of the elastic member in a released state.
Figure 51:
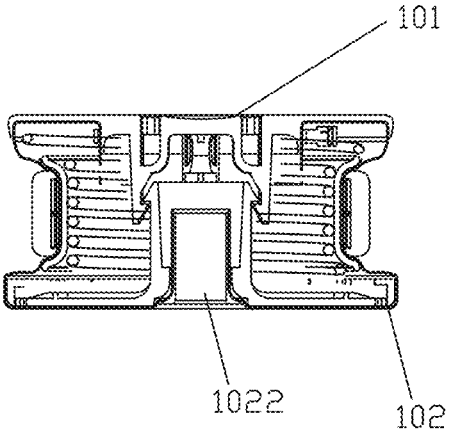
FIG. 51 shows a perspective view of the elastic member in a compressed state.

Referring to FIGS. 50-51, in this embodiment, in order to facilitate transportation or relocation of the elastic mattress after disassembly, the plurality of elastic members 10 can be compressed to a locked state. A height of the plurality of elastic members 10 in the locked state is greatly reduced, occupied space is reduced, and the transportation and the relocation are facilitated.

More specifically, each of the plurality of elastic members 10 comprises a top cover 101 and a bottom cover 102. The top cover 101 comprises a first positioning structure 1011, the bottom cover 102 comprises a second positioning structure 1021, and the first positioning structure 1011 is detachably buckled to the second positioning structure 1021. A lower end surface of the bottom cover 102 of each of the plurality of elastic members 10 comprises a corresponding one of the plurality of cavities 1022 positioned to and cooperating with a corresponding one of the plurality of positioning protrusions 31. The bottom cover 102 defines a top surface of the corresponding one of the plurality of cavities 1022, and the second positioning structure 1021 is discontinuous flanges disposed on a periphery of an upper end of the corresponding one of the plurality of cavities 1022. Each of the plurality of elastic members 10 is compressed using an external force to enable hooks of the first positioning structure 1011 and the discontinuous flanges of the second positioning structure 1021 to be buckled together, thereby achieving a compression (i.e., a locked state) of the plurality of elastic members 10. The external force can be then used to enable each of the plurality of elastic members 10 to rotate to enable the first positioning structure 1011 to be separated from the second positioning structure 1021 to achieve releasing of each of the plurality of elastic members from the locked state.

Embodiment 2

Referring to FIGS. 12-20, this embodiment differs from Embodiment 1 in that, in this embodiment, middle parts of the plurality of elastic members 10 are disposed with connecting members 12, each of the connecting members 12 comprises a connecting seat 120, insertion members 121 as one or more first connecting structures 1210 are detachably disposed on two first opposite sides of the connecting seat 120, and insertion sockets 122 as one or more first connecting structures 1220 are detachably disposed on two second opposite sides of the connecting seat 120.

The insertion members 121 are inserted into the insertion sockets 122 in a downward direction. That is, the insertion members 121 are inserted into the insertion sockets 122 in a height direction of the plurality of elastic members 10. The insertion sockets 122 comprise first openings 1222 in an insertion direction of the insertion members 121. The insertion sockets 122 comprise second openings 1223 in a direction opposite to the insertion direction of the insertion members 121, so that the insertion sockets 122 have more elasticity to enable a cooperation between the insertion members 121 and the insertion sockets 122 to be tighter.

The connecting seat 120 can be divided into a left connecting seat component 1202 and a right connecting seat component 1203, and tail ends of the left connecting seat component 1202 and the right connecting seat component 1203 comprise buckling strips 1201. The insertion members 121 are rectangular, and first sides of the insertion members 121 facing a corresponding one of the connecting members 12 comprise insertion slots 1212. The buckling strips 1201 of the left connecting seat component 1202 and the right connecting seat component 1203 are inserted into the insertion slots 1212 of the insertion members 121, so that the left connecting seat component 1202 and the right connecting seat component 1203 are buckled to each other to form a ring-shaped connecting seat 120 buckled to a corresponding one of the middle parts of the plurality of elastic members 10. One or two sides of each of the insertion members 121 comprise one or more protrusions 1211 as the positioning structure 1213. Two side walls of each of the insertion sockets 122 corresponding to the one or more protrusions 1211 comprise releasing members 1221, and the releasing members 1221 and the two side walls of each of the insertion sockets 122 form a space 1224 to which the one or more protrusions 1211 can be buckled. The insertion members 121 can be inserted into the insertion sockets 122 in a vertical direction, and the one or more protrusions 1211 are buckled to the space 1224 on two side walls of a corresponding one of the insertion sockets 122. At this time, the insertion members 121 are positioned to and cooperate with the insertion sockets 122 to achieve the connection between the pluralities of elastic members 10. The releasing members 1221 are pressed to push the one or more protrusions 1211 to separate from the space 1224 on the two side walls of each of the insertion sockets 122 to release a connection between two adjacent elastic members 10 of the plurality of elastic members 10.

In this embodiment, referring to 17-19, the one or more strips 20 with pull buckles comprise one or more protrusions 202 having same structures as in the insertion members 121 and configured to be connected to corresponding insertion sockets 122 on the connecting members 12. As a simple alternative to this embodiment, the one or more strips 20 with pull buckles comprise one or more grooves having same structures as in the insertion members 121 and configured to be connected to corresponding insertion members 121 on the connecting members 12.

Embodiment 3

Referring to FIGS. 21-31, this embodiment differs from Embodiment 1 in that middle parts of the plurality of elastic members 10 are disposed with connecting members 13, each of the connecting members 13 comprises a connecting seat 130, and T-shaped protrusions 1311 (i.e., insertion members 131) are disposed on two first opposite sides of the connecting seat 130 as one or more first connecting structures 1310. Holes 1326 (i.e., insertion sockets 132) are disposed on two second opposite sides of the connecting seat 130, and push buttons 1321 configured to move up and down in a vertical direction and configured to lock the T-shaped protrusions 1311 are sleeved on elements 1325 having the holes 1326 to define one or more second connecting structure 1320. The connecting seat 130 is detachably divided into a left connecting seat component 1304 and a right connecting seat component 1305.

Two tail ends of the left connecting seat component 1304 and two tail ends of the right connecting seat component 1305 respectively comprise inserting blocks 1301 and inserting holes 1302. The inserting blocks 1301 are disposed in the inserting holes 1302 to form a corresponding ring-shaped connecting member 13 of the connecting members 13 fixedly connected to a corresponding one of the middle parts of the plurality of elastic members 10. Protruding blocks 1303 are formed at combinations of the left connecting seat component 1304 and the right connecting seat component 1305. An end of each of elements 1325 facing a corresponding one of the connecting members 13 comprises a slot 1324, and a corresponding one of the protruding blocks 1303 is disposed in the slot 1324 to enable the holes 1326 to be fixedly connected to the connecting seat 130.

Figure 25:
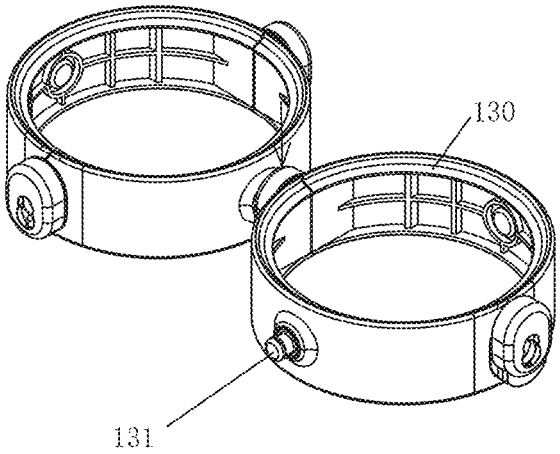
FIG. 25 shows a diagrammatic view of a graphical object of a locked state of the protrusion in Embodiment 3.
Figure 26:
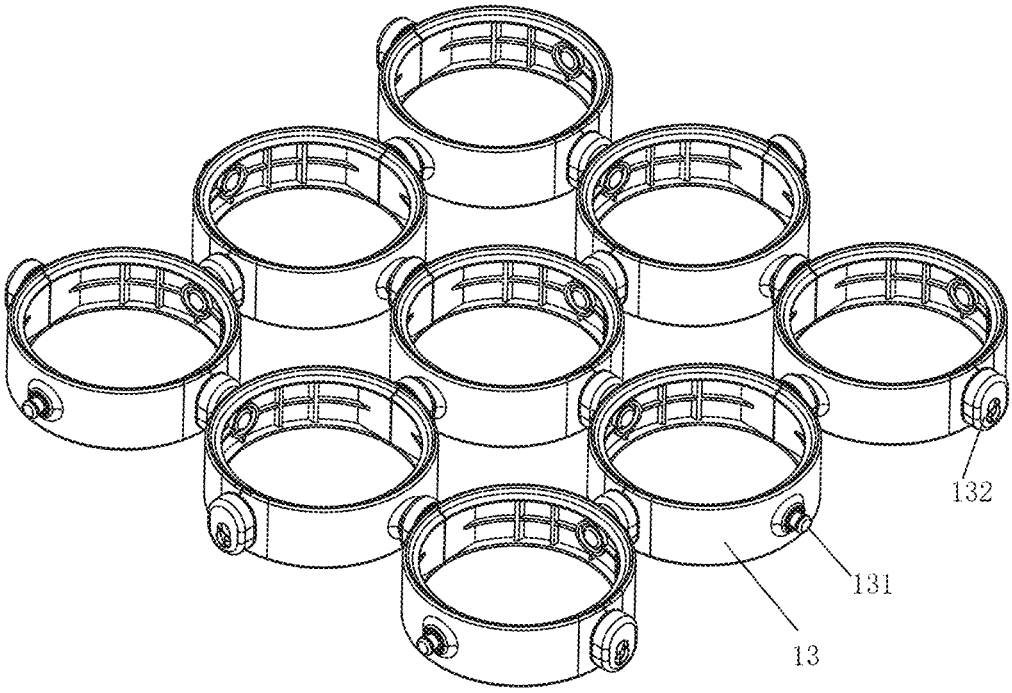
FIG. 26 shows a diagrammatic view of a graphical object of a connecting relation in Embodiment 3.
Figure 27:
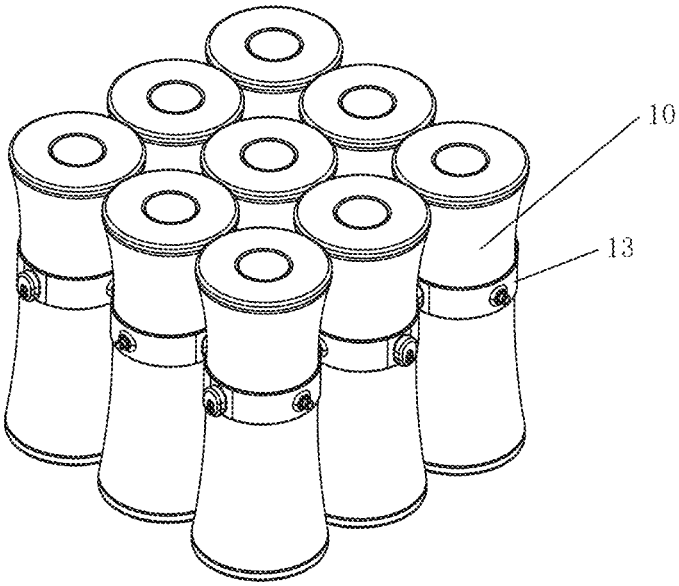
FIG. 27 shows a diagrammatic view of a graphical object of an elastic module in Embodiment 3.
Figure 28:
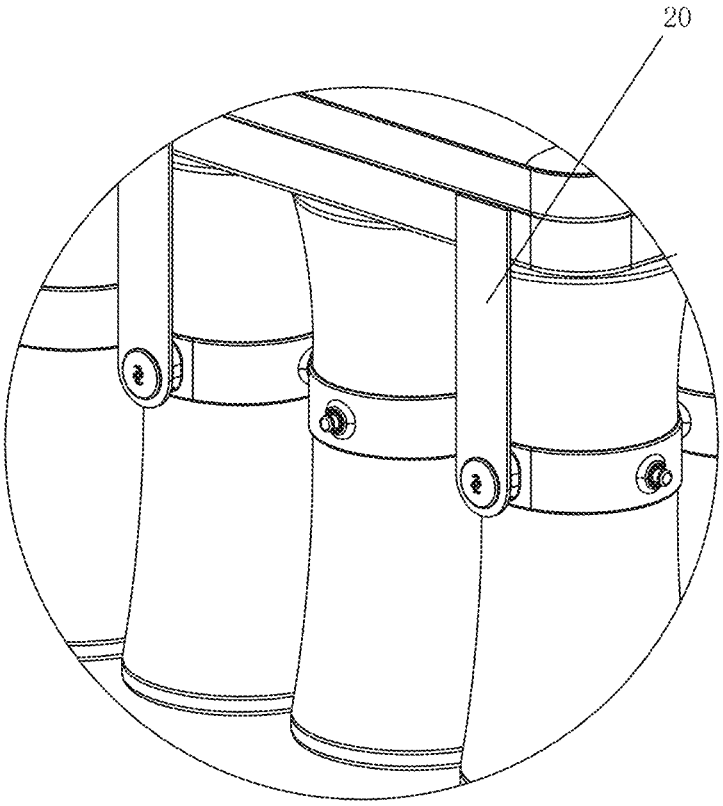
FIG. 28 shows a diagrammatic view of a strip with a pull buckle connected to the elastic module in Embodiment 3.
Figure 29:
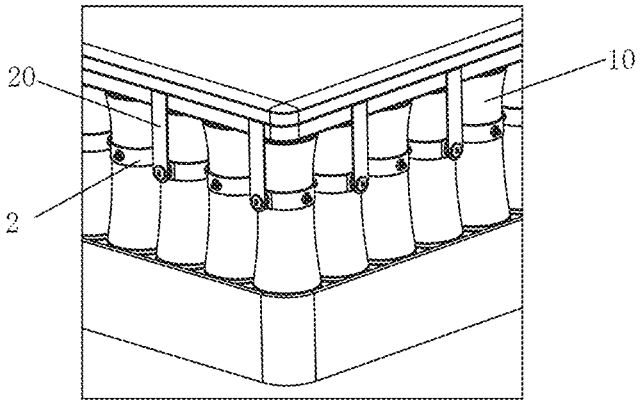
FIG. 29 shows a diagrammatic view of a graphical object of the strip with the pull buckle connected to the elastic module in Embodiment 3.

More specifically, the push buttons 1321 comprise buckling holes 1322 corresponding to the holes 1326, and the push buttons 1321 comprise positioning holes 1323 having a diameter smaller than a diameter of the buckling holes 1322 and disposed above the buckling holes 1322. When the plurality of elastic members 10 are connected together, each of the T-shaped protrusions 1311 on a first one of the plurality of elastic members 10 passes through a corresponding one of the buckling holes 1322 on a second one of the plurality of elastic members 10 to be buckled to a corresponding one of the holes 1326 on the second one of the plurality of elastic members 10, as shown in in FIG. 24. In this state, the corresponding one of the T-shaped protrusions 1311 passes through the corresponding one of the holes 1326 and the corresponding one of the buckling holes 1322, and a corresponding one of the push buttons 1321 is pressed downwardly to enable the corresponding one of the T-shaped protrusions 1311 to be locked by a corresponding one of the positioning holes 1323 to achieve a mutual connection between the plurality of elastic members 10, as shown in FIG. 25. When the plurality of elastic members 10 are disassembled, the push buttons 1321 are pressed upwardly until the buckling holes 1322 are aligned with the holes 1326 to release from locking, and the T-shaped protrusions 1311 are separated from the holes 1326 to unlock the mutual connection between the plurality of elastic members 10.

In this embodiment, referring to FIGS. 28-31, the one or more strips 20 with the pull buckles of the upper cushion layer 2 comprise one or more T-shaped protrusions 203. The one or more T-shaped protrusions 203 can pass through corresponding ones of the buckling holes 1322 on corresponding connecting members of one or more outermost elastic members 10 of the plurality of elastic members 1 to be buckled to corresponding ones of the holes 1326, and corresponding ones of the push buttons 1321 can be pressed downwardly to enable the corresponding ones of the T-shaped protrusions 203 to be locked to achieve a detachable connection of the upper cushion layer 2 and a corresponding one of the plurality of elastic modules 1. The remaining features are the same as in Embodiment 1 and will not be described herein.

Embodiment 4

Referring to FIGS. 30 and 32-35, this embodiment differs from Embodiment 1 in that middle parts of the plurality of elastic members 10 are disposed with connecting members 14, each of the connecting members 14 comprises a connecting seat 140, and T-shaped protrusions 1411 (i.e., insertion members 141) are disposed on two first opposite sides of the connecting seat 140 as one or more first connecting structures 1410. Grooves 1423 and knobs 1421 are disposed on two second opposite sides of the connecting seat 130, and the knobs 1421 are sleeved on the grooves 1423 (i.e., insertion sockets 142) to combine together to define one or more second connecting structures 1420. The knobs 1421 comprise spaces 1422 to enable the T-shaped protrusions 1411 to be buckled the grooves 1423. The connecting seat 140 is divided into two detachable parts 1401 and 1402 (i.e., connecting seat components 1401 and 1402), and the two detachable parts 1401 and 1402 are buckled to each other to form a ring-shaped connecting seat 140.

When the plurality of elastic members 10 are connected to one another, each of the T-shaped protrusions 1411 on a first one of the plurality of elastic members 10 is buckled to a corresponding one of the grooves 1423 of a second one of the plurality of elastic members 10 by a corresponding one of the knobs 1421. At this time, the T-shaped protrusions 1411 are positioned to and cooperate with the grooves 1423 in a horizontal direction. The knobs 1421 rotate to enable the T-shaped protrusions 1411 to be positioned to and cooperate with the knobs 1421 in a vertical direction. At this time, the T-shaped protrusions 1411 are locked by the knobs 1421 to achieve a connection between adjacent elastic members 10 of the plurality of elastic members 10. When the plurality of elastic members 10 are disassembled, the knobs 1421 rotate to enable the T-shaped protrusions 1411 to be released from locking, and the T-shaped protrusions 1411 can be separated from the grooves 1423 to release the connection between the adjacent elastic members 10.

Figure 30:
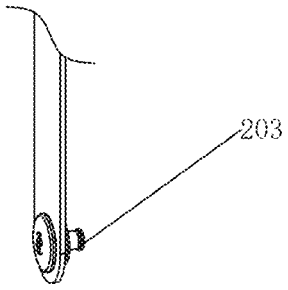
FIG. 30 shows a diagrammatic view of the strip with the pull buckle in Embodiment 3.
Figure 31:
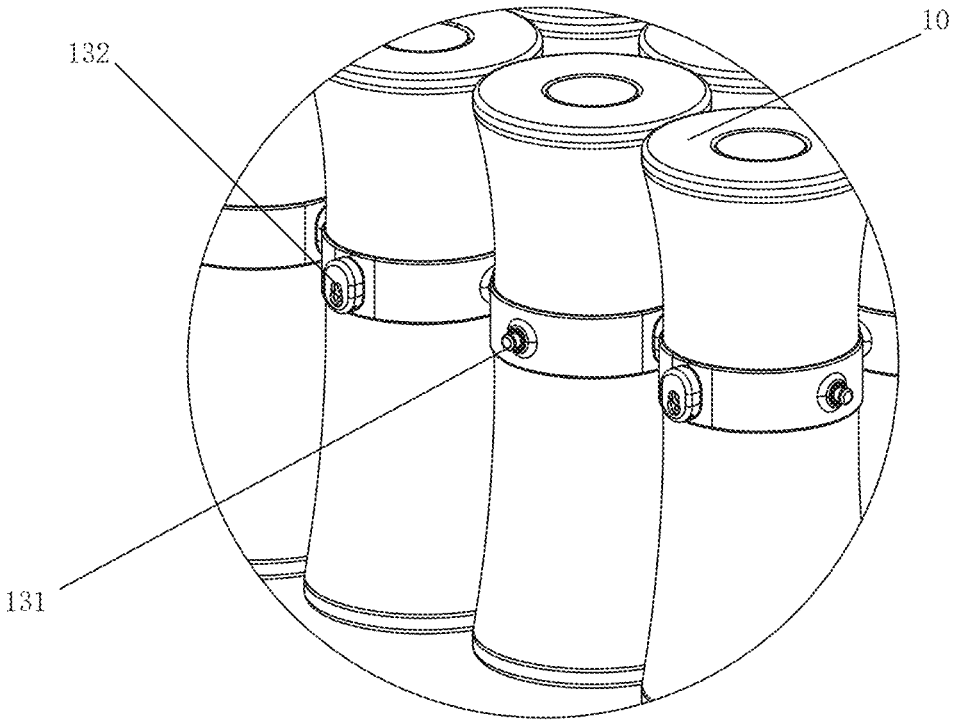
FIG. 31 shows a perspective view of one or more peripheral elastic members of the elastic module in Embodiment 3.
Figure 32:
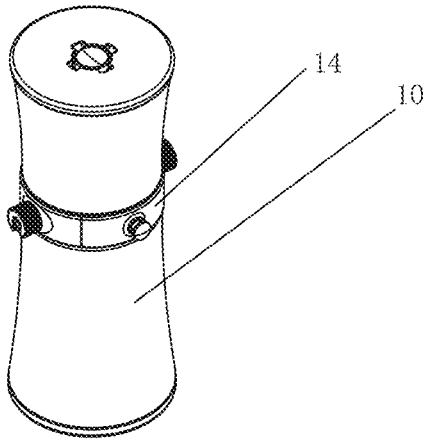
FIG. 32 shows a diagrammatic view of an elastic member in Embodiment 4.
Figure 33:
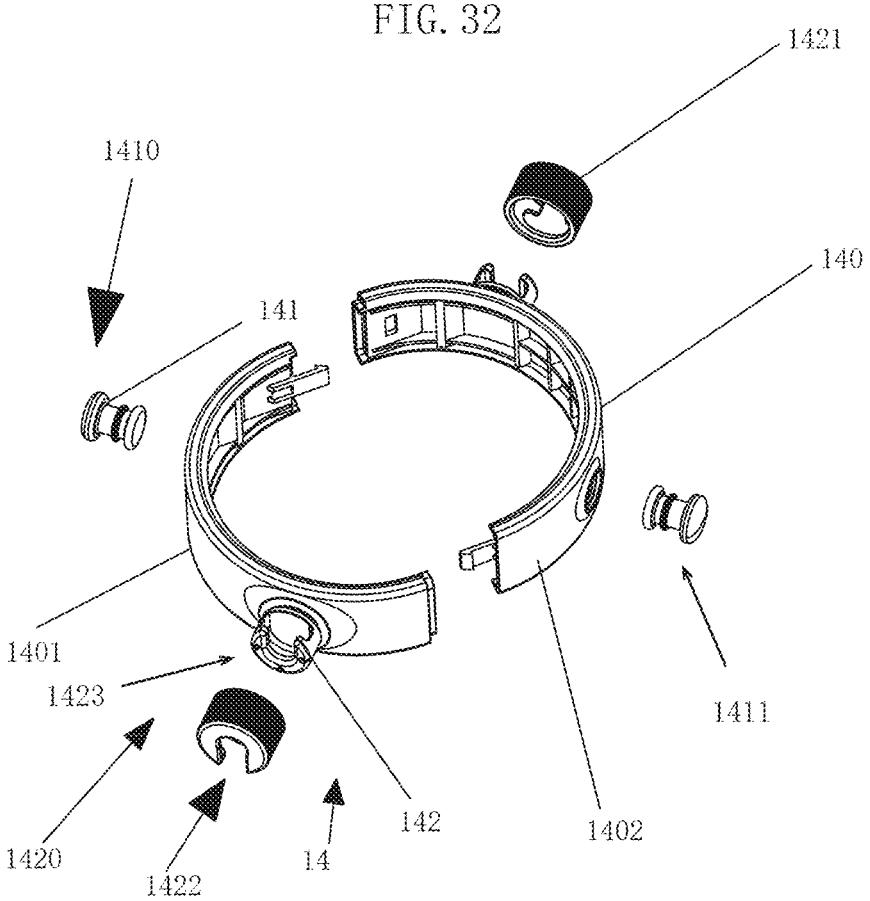
FIG. 33 shows a diagrammatic view of a connecting member in Embodiment 4.
Figure 34:
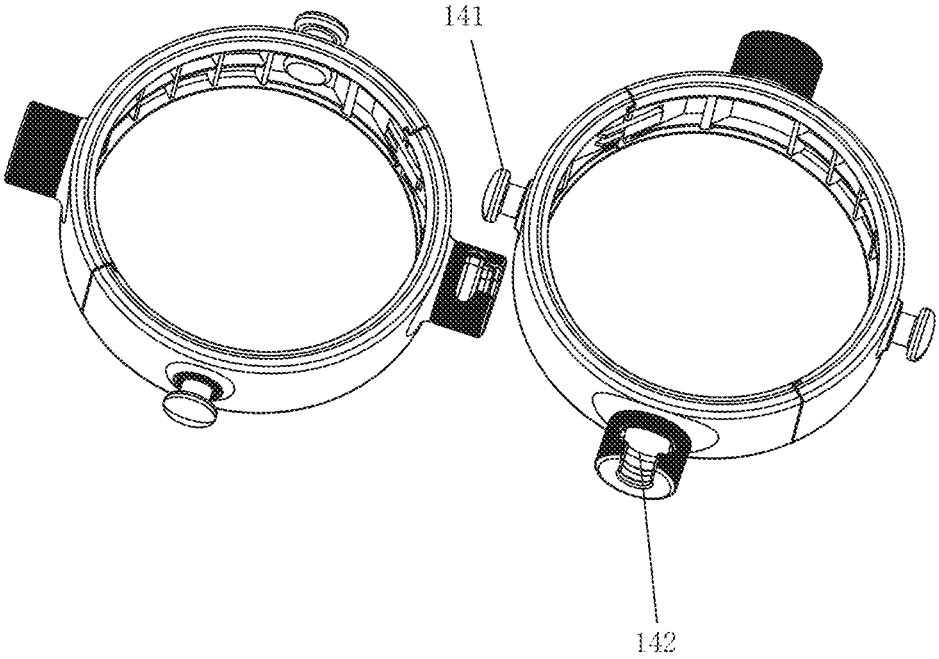
FIG. 34 shows a diagrammatic view of a connection arrangement in Embodiment 4.
Figure 35:
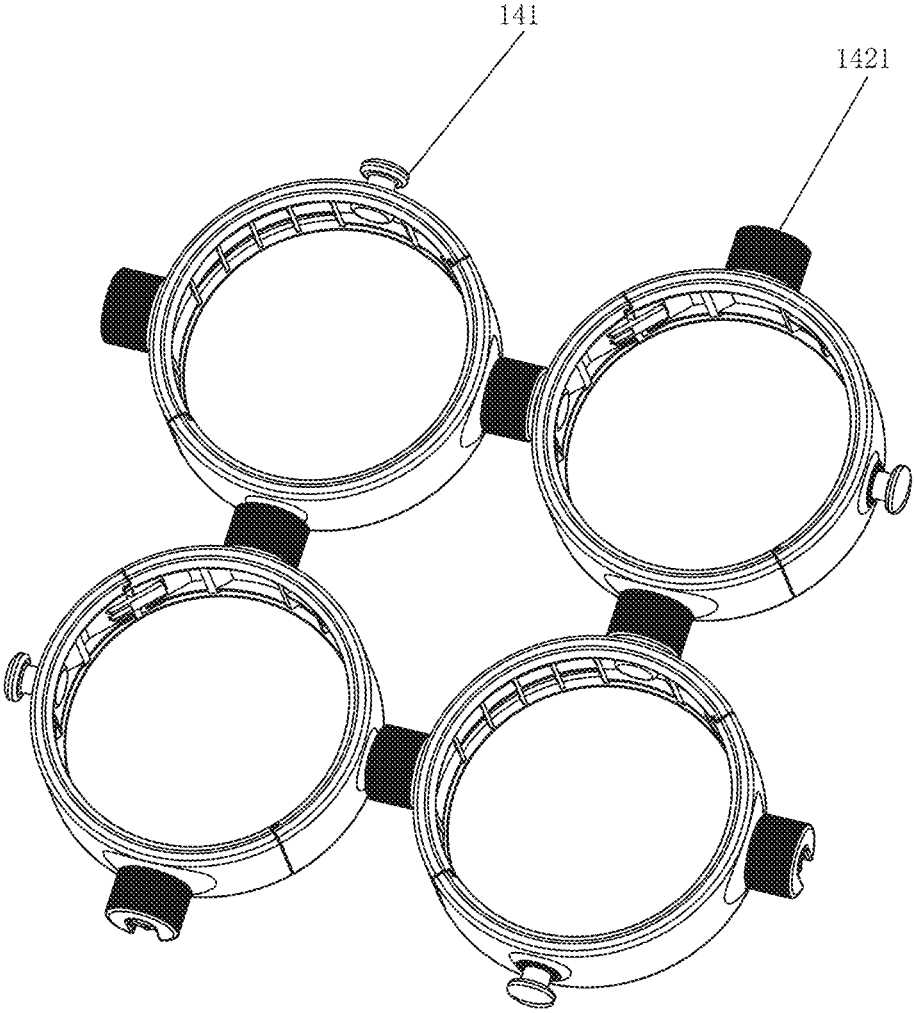
FIG. 35 shows a diagrammatic view of a connection relation in Embodiment 4.
Figure 36:
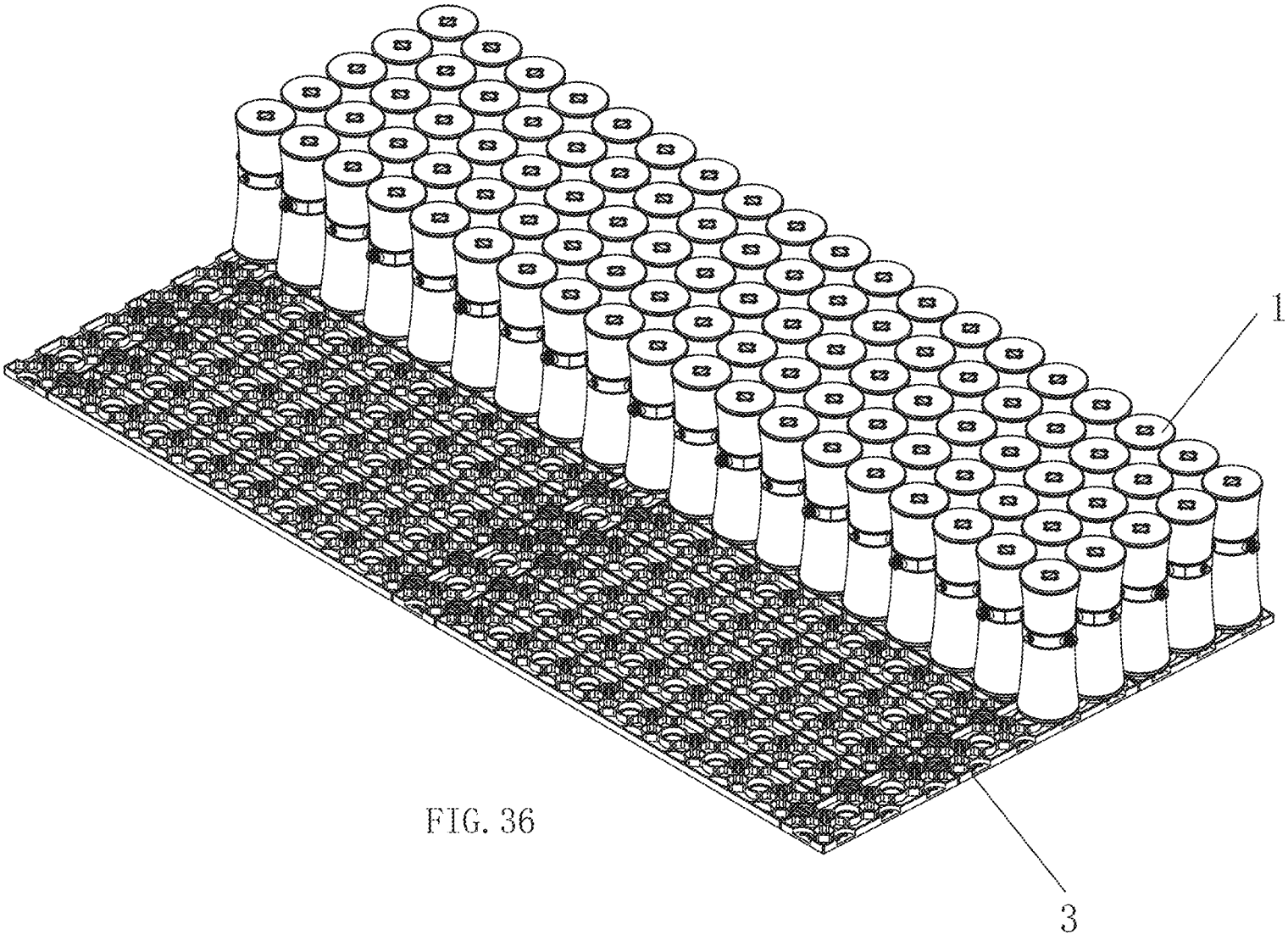
FIG. 36 shows a diagrammatic view of an elastic module connected to a base.
Figure 37:
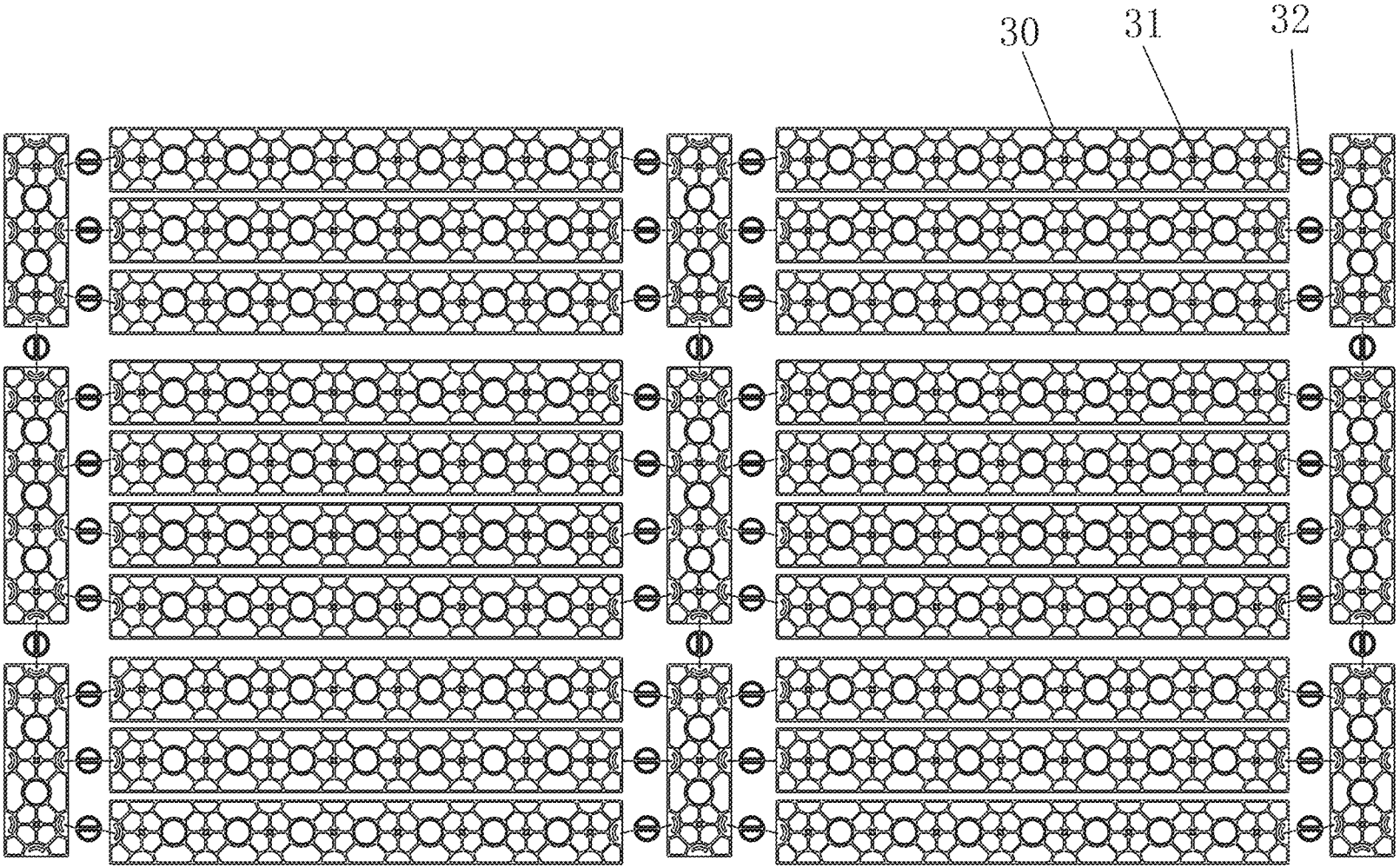
FIG. 37 shows a diagrammatic view of the base spliced by 8-seat bottom layer units.
Figure 38:
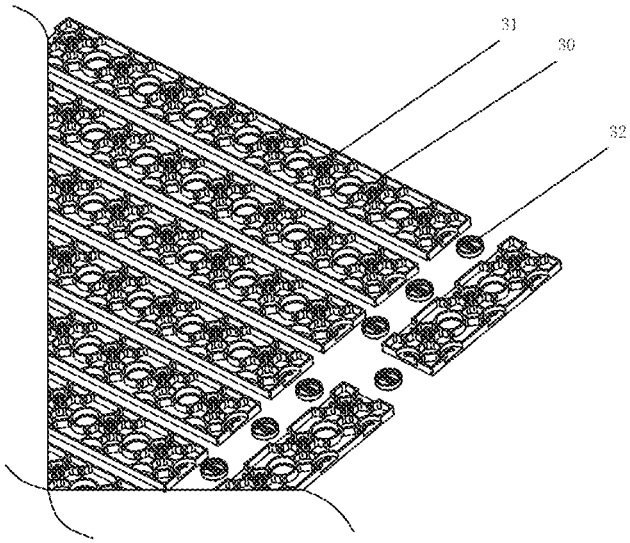
FIG. 38 shows a partial view of the base with all of the bottom layer units having positioning protrusions.
Figure 40:
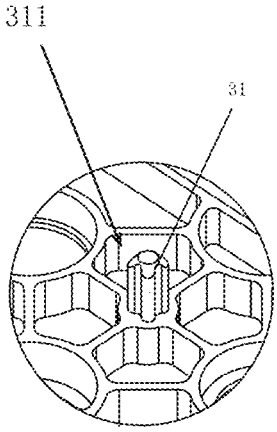
FIG. 40 shows a diagrammatic view of the positioning protrusions.
Figure 39:
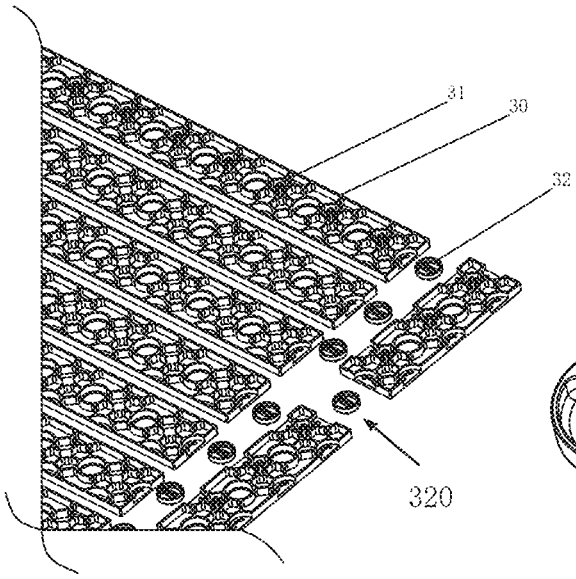
FIG. 39 shows a partial view of the base with side bottom layer units of the bottom layer units having the positioning protrusions.
Figure 41:
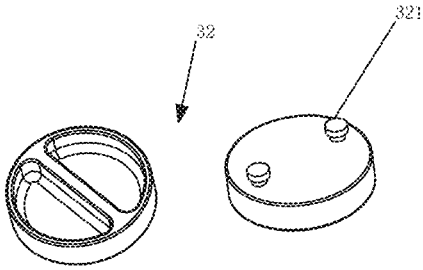
FIG. 41 shows a diagrammatic view of a connection knob.
Figure 42:
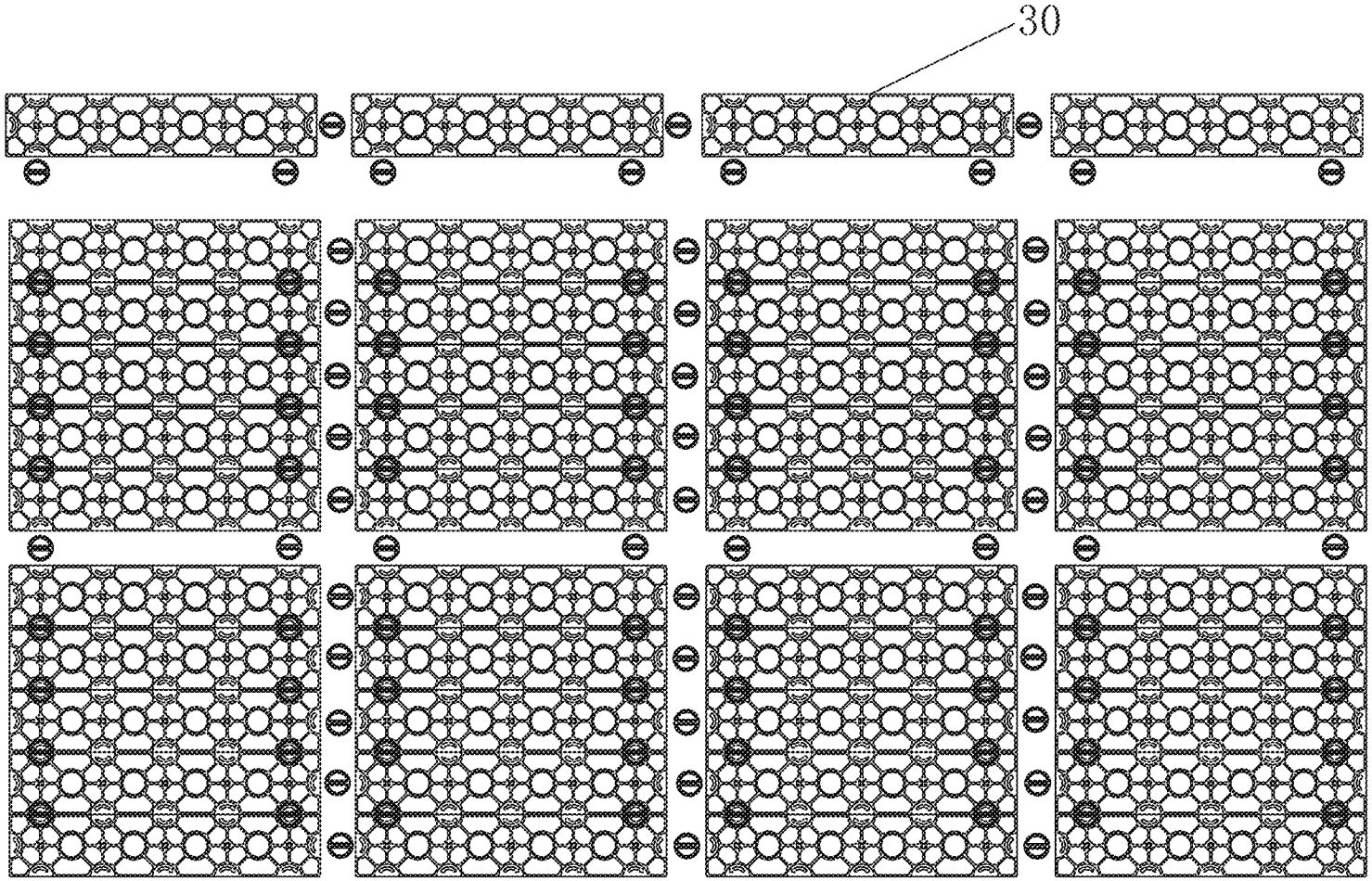
FIG. 42 shows a diagrammatic view of the base spliced by 5-seat bottom layer units.
Figure 43:
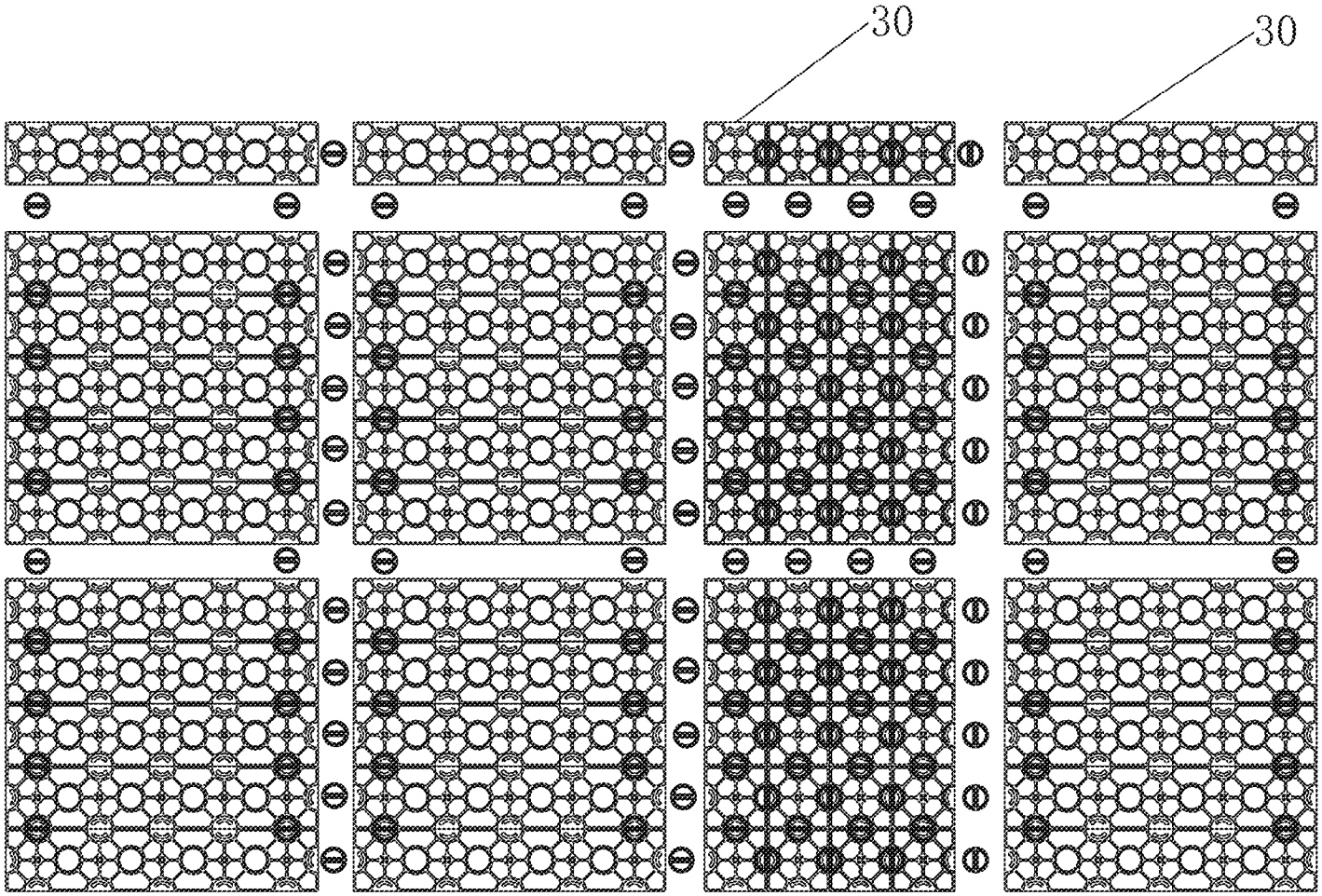
FIG. 43 shows a diagrammatic view of the base spliced by 5-seat bottom layer units and 1-seat bottom layer units.
Figure 44:
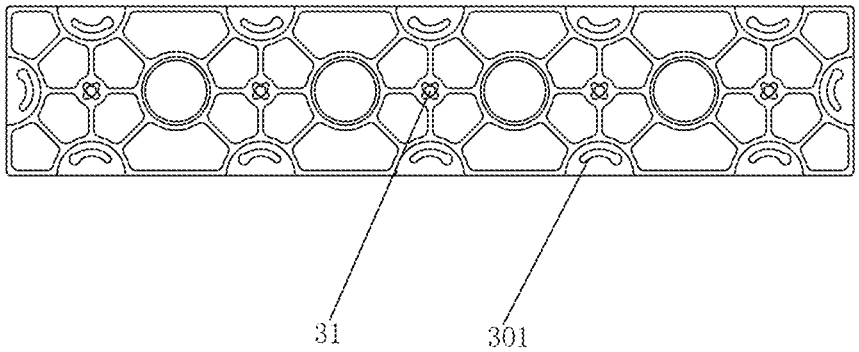
FIG. 44 shows a diagrammatic view of one of the 5-seat bottom layer units.
Figure 45:
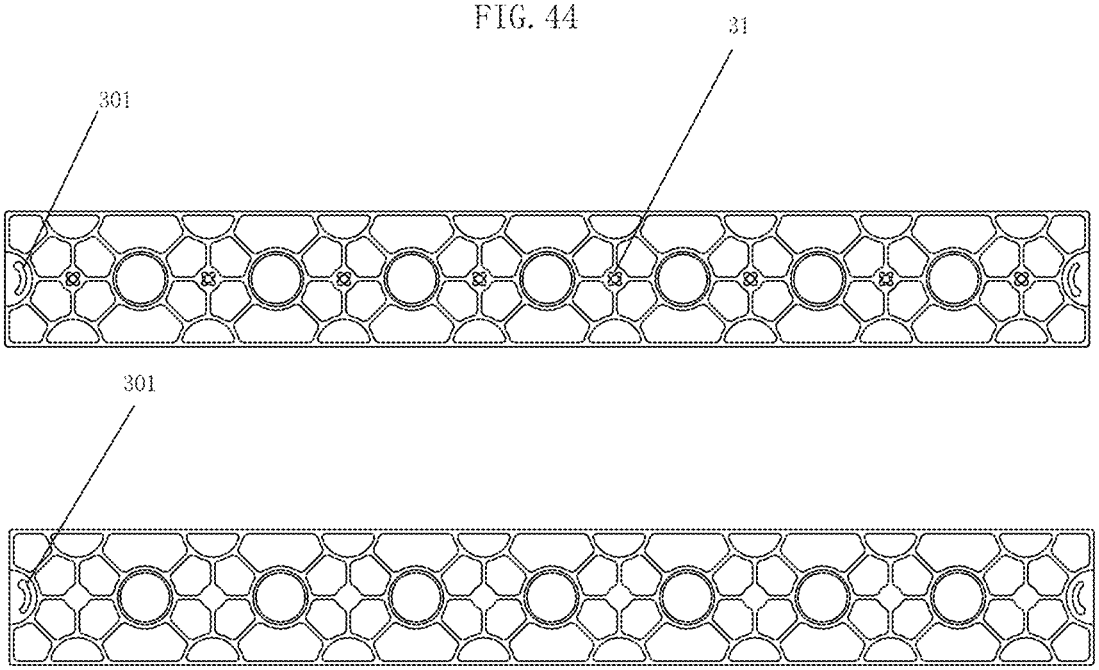
FIG. 45 shows a diagrammatic view of one of the 8-seat bottom layer units.
Figure 46:
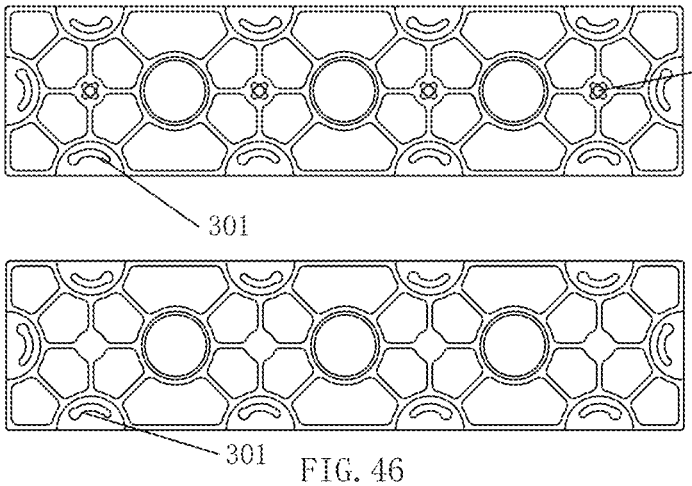
FIG. 46 shows a diagrammatic view of one of the 3-seat bottom layer units.
Figure 47:
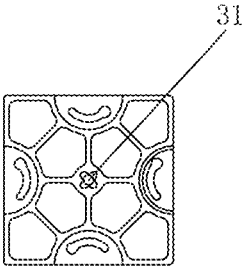
FIG. 47 shows a diagrammatic view of one of the 1-seat bottom layer units.
Figure 48:
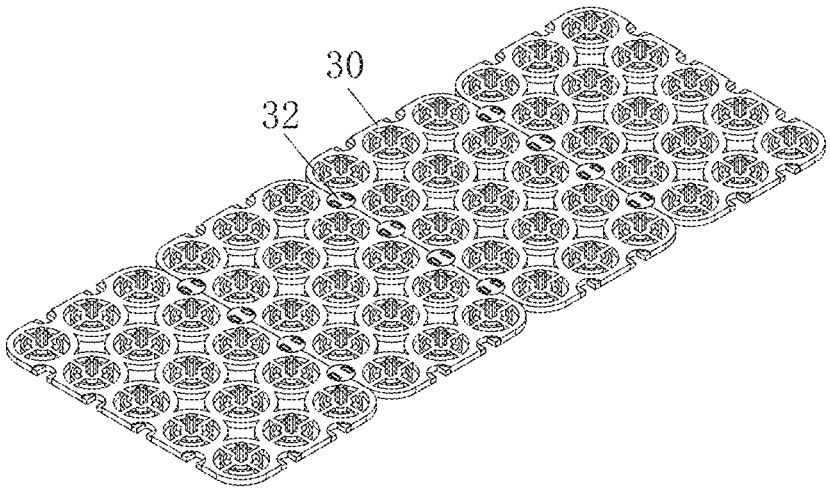
FIG. 48 shows a view of a graphical object of the base.
Figure 49:
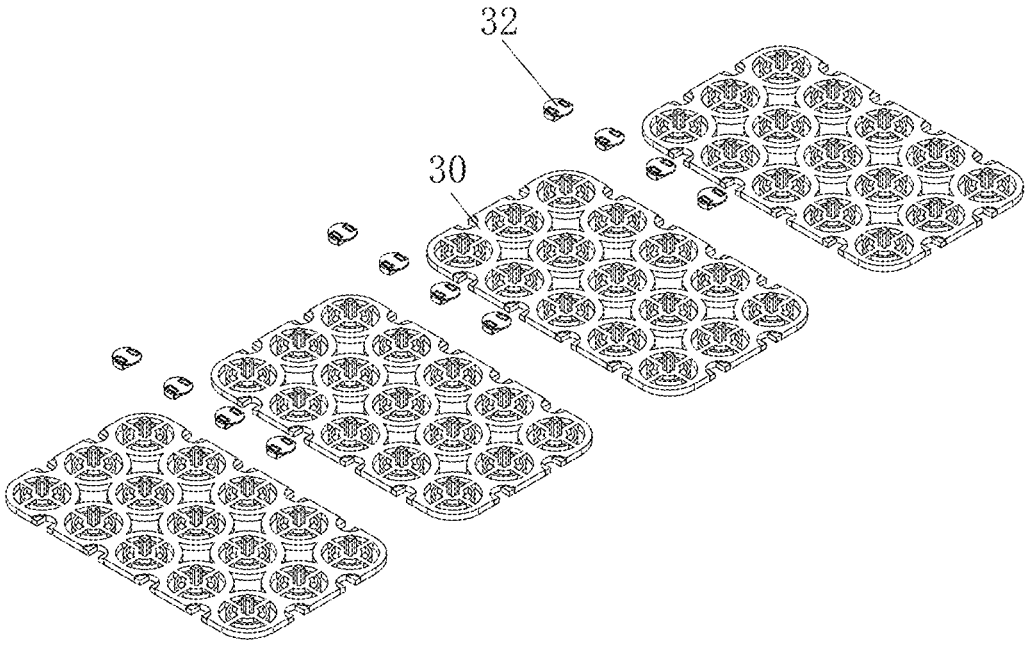
FIG. 49 shows a view of a graphical object of the base in a disassembled state.

In this embodiment, referring to FIG. 30, the one or more strips 20 with pull buckles comprise one or more T-shaped protrusions 203. The one or more T-shaped protrusions 203 of the one or more strips 20 with pull buckles can be buckled to corresponding ones of the grooves 1423 on one or more outermost elastic members 10 of the plurality of elastic members 10, and the knobs 1421 can rotate to enable the T-shaped protrusions 203 to be locked to the knobs 1421 to achieve a detachable connection between the upper cushion layer 2 and a corresponding one of the plurality of elastic modules 1. The remaining features are the same as in Embodiment 1 and will not be described herein.

The description of the specification and the embodiments is used to explain the protective scope of the present disclosure, and the protective scope of the present disclosure is not limited thereto. It is intended that the protective scope of the present disclosure coves modifications, equivalent substitutions, or other improvements of the embodiments of the present disclosure or some of the technical features thereof provided that they are obtained by a person of ordinary skill in the art through logical analysis, reasoning, or limited tests based on the revelation from the present disclosure or the embodiments by combining common knowledge, ordinary technical knowledge in the art, and/or existing techniques together.

What is claimed is:

1. An elastic mattress for furniture, comprising:
one or more elastic modules, and
one or more bottom layers disposed below the one or more elastic modules, wherein:
the one or more elastic modules comprise a plurality of elastic members,
middle parts of the plurality of elastic members are disposed with connecting members,
adjacent elastic members of the plurality of elastic members are connected to each other by corresponding ones of the connecting members,
connecting structures of side surfaces of a corresponding one of the connecting members of the plurality of elastic members comprise one or more first connecting structures and one or more second connecting structures,
the one or more first connecting structures and the one or more second connecting structures are disposed on adjacent ones of the side surfaces of the corresponding one of the connecting members,
bottom surfaces of the plurality of elastic members are connected to the one or more bottom layers,
the connecting members comprise connecting seats,
the connecting seats are sleeved on the middle parts of the plurality of elastic members,
each of the connecting seats comprises one or more insertion members as the one or more first connecting structures,
each of the connecting seats comprises one or more insertion sockets as the one or more second connecting structures, and
a male and female connection of a first one of the one or more insertion members on a first one of the plurality of elastic members and a first one of the one or more insertion sockets on a second one of the plurality of elastic members achieves a connection between the plurality of elastic members.

2. The elastic mattress for furniture according to claim 1, wherein:

each of the connecting seats comprises four side surfaces, the one or more insertion members comprise two or more insertion members, the one or more insertion sockets comprise two or more insertion sockets, a first one of the two or more insertion members and a first one of the two or more insertion sockets are respectively disposed on two first opposite side surfaces of the four side surfaces of each of the connecting seats, and a second one of the two or more insertion members and a second one of the two or more insertion sockets are respectively disposed on two second opposite side surfaces of the four side surfaces of each of the connecting seats, or each of the connecting seats comprises four side surfaces, the two or more insertion members are disposed on two first opposite side surfaces of the four side surfaces of each of the connecting seats, and the two or more insertion sockets are disposed on two second opposite side surfaces of the four side surfaces of each of the connecting seats.

3. The elastic mattress for furniture according to claim 2, wherein:

the two or more insertion members comprise one or more positioning structures configured to be positioned to and cooperate with one or more side walls of the two or more insertion sockets, the one or more positioning structures have elasticity, the one or more side walls of the two or more insertion sockets corresponding to the one or more positioning structures are disposed with one or more releasing members configured to be pushed to move the one or more positioning structures through the elasticity of the one or more positioning structures, and the one or more releasing members are configured to be pressed to enable the one or more positioning structures to be separated from the two or more insertion sockets to achieve a disassembly of the plurality of elastic members.

4. The elastic mattress for furniture according to claim 3, wherein:

the one or more positioning structures comprise one or more protrusions disposed on upper sides of the two or more insertion members, and one or more upper side walls of the two or more insertion sockets comprise one or more spaces in which the one or more protrusions are clamped to enable the one or more positioning structures to be positioned to and cooperate with the two or more insertion sockets.

5. The elastic mattress for furniture according to claim 3, wherein:

the one or more positioning structures comprise one or more protrusions disposed on two sides or a single side of the two or more insertion members, and the one or more releasing members and the one or more side walls of the two or more insertion sockets form one or more spaces in which the one or more protrusions are clamped to enable the one or more positioning structures to be positioned to and cooperate with the two or more insertion sockets.

6. The elastic mattress for furniture according to claim 3, wherein:

the two or more insertion members comprise one or more T-shaped protrusions, the two or more insertion sockets comprise one or more holes, one or more push buttons configured to move up and down in a vertical direction are sleeved on an outer side of the one or more holes, the one or more push buttons comprise one or more buckling holes corresponding to the one or more holes, the one or more push buttons comprise one or more positioning holes having a diameter smaller than a diameter of the one or more buckling holes and disposed above the one or more buckling holes, a first one of the one or more T-shaped protrusions on a first one of the connecting members on the first one of the plurality of elastic members passes through a first one of the one or more buckling holes on a second one of the connecting members of on the second one the plurality of elastic members to be clamped in a first one of the one or more holes of the second one of the connecting members on the second one of the plurality of elastic members, and the one or more push buttons are pressed to enable the one or more T-shaped protrusions to be locked by the one or more positioning holes, so as to achieve a mutual connection between the plurality of elastic members.

7. The elastic mattress for furniture according to claim 2, wherein:

the two or more insertion members comprise one or more protrusions, the two or more insertion sockets comprise one or more grooves, one or more knobs are sleeved on outer sides of the one or more grooves, the one or more knobs comprise one or more spaces in which the one or more protrusions are clamped to the one or more grooves, the one or more protrusions are clamped to the one or more grooves, and the one or more knobs rotate to enable the one or more protrusions to be locked to achieve a mutual connection between the plurality of pre compressed springs elastic members.

8. The elastic mattress for furniture according to claim 2, wherein:

each of the connecting seats comprises two or more connecting seat components, and the two or more connecting seat components are detachably buckled to a corresponding one of the plurality of elastic members.

9. The elastic mattress for furniture according to claim 1, wherein:

the one or more elastic modules comprise a plurality of elastic modules, and one or more peripheral elastic members of the plurality of elastic members on a first one of the plurality of elastic modules and one or more peripheral elastic members of the plurality of elastic members on a second one of the plurality of elastic modules are connected together using one or more lap joints or corresponding ones of the connecting members.

10. The elastic mattress for furniture according to claim 1, further comprising:

an upper cushion layer, wherein:

the upper cushion layer is detachably connected to one or more outermost elastic members of the plurality of elastic members on a corresponding one of the one or more elastic modules.

11. The elastic mattress for furniture according to claim 10, wherein:

a periphery of the upper cushion layer comprises a plurality of strips having pull buckles, and the plurality of strips having pull buckles are connected to corresponding ones of the connecting members on peripheral elastic members of the plurality of elastic members.

12. The elastic mattress for furniture according to claim 1, wherein:

each of the one or more bottom layers is an integrated structure, or each of the one or more bottom layers comprises a plurality of bottom layer units detachably spliced together.

13. The elastic mattress for furniture according to claim 12, wherein:

the one or more bottom layers are is a plurality of bottom layers, and the plurality of bottom layers are detachably spliced together to form a base for the elastic mattress.

14. The elastic mattress for furniture according to claim 13, wherein:

the plurality of bottom layers are connected together through third members or the plurality of bottom layer units are connected together through the third members, the third members are connecting knobs, a bottom of each of the connecting knobs comprises two T-shaped buckling pins symmetrical to each other, a periphery of each of the plurality of bottom layer units or a periphery of each of the plurality of bottom layers comprises sliding rails, each of the sliding rails is configured to be connected to the two T-shaped buckling pins of a corresponding one of the connecting knobs, the sliding rails narrow along a rotation direction of the connecting knobs, the two T-shaped buckling pins of each of the connecting knobs are respectively buckled to a wide part of a corresponding one of the sliding rails on a first bottom layer unit of the plurality of bottom layer units or a first bottom layer of the plurality of bottom layers and a wide part of a corresponding one of the sliding rails on a second bottom layer unit of the plurality of bottom layer units adjacent to the first bottom layer unit or a second bottom layer of the plurality of bottom layers adjacent to the first bottom layer, and each of the connecting knobs rotates to enable the two T-shaped buckling pins to be positioned to a narrow part of the corresponding one of the sliding rails on the first bottom layer unit or the first bottom layer and a narrow part of the corresponding one of the sliding rails on the second bottom layer unit or the second bottom layer, so as to achieve a connection between the first bottom layer unit and the second bottom layer unit or a connection between the first bottom layer and the second bottom layer.

15. The elastic mattress for furniture according to claim 12, wherein the plurality of elastic members are connected to the one or more bottom layers through fixing members.

16. The elastic mattress for furniture according to claim 15, wherein at least part of each of the one or more bottom layers is disposed with the fixing members.

17. The elastic mattress for furniture according to claim 16, wherein:

the fixing members are a plurality of positioning protrusions disposed on the plurality of bottom layer units, lower end surfaces of the plurality of elastic members comprise a plurality of cavities configured to be positioned to and cooperate with the plurality of positioning protrusions, and the plurality of elastic members are connected to the one or more bottom layers by a plug-in connection between the plurality of positioning protrusions and the plurality of cavities.

18. The elastic mattress for furniture according to claim 1, wherein the plurality of elastic members are compressed to a locked state.

19. The elastic mattress for furniture according to claim 18, wherein:

each of the plurality of elastic members comprises a top cover and a bottom cover, positioning structures are disposed between the top cover and the bottom cover, and the top cover and the bottom cover are buckled to each other through the positioning structures to enable each of the plurality of elastic members to be compressed to the locked state.

20. The elastic mattress for furniture according to claim 19, wherein:

the positioning structures are divided into a first positioning structure and a second positioning structure, the first positioning structure is disposed on a lower end surface of the top cover, the second positioning structure is disposed on an upper end surface of the bottom cover, the first positioning structure and the second positioning structure are detachably buckled to each other, when the first positioning structure and the second positioning structure are buckled to each other, each of the plurality of elastic members is compressed, and when the first positioning structure and the second positioning structure are detached from each other, each of the plurality of elastic members is released.

21. A method for applying the elastic mattress for furniture, comprising: applying the elastic mattress for furniture according to claim 1 in a sofa, a bed mattress, or a soft stool.

22. An elastic mattress for furniture, comprising:

one or more elastic modules, one or more bottom layers disposed below the one or more elastic modules, and an upper cushion layer, wherein:

the one or more elastic modules comprise a plurality of elastic members, middle parts of the plurality of elastic members are disposed with connecting members, adjacent elastic members of the plurality of elastic members are connected to each other by corresponding ones of the connecting members, connecting structures of side surfaces of a corresponding one of the connecting members of the plurality of elastic members comprise one or more first connecting structures and one or more second connecting structures, the one or more first connecting structures and the one or more second connecting structures are disposed on adjacent ones of the side surfaces of the corresponding one of the connecting members, bottom surfaces of the plurality of elastic members are connected to the one or more bottom layers, and the upper cushion layer is detachably connected to one or more outermost elastic members of the plurality of elastic members on a corresponding one of the one or more elastic modules.

23. An elastic mattress for furniture, comprising:

one or more elastic modules, and one or more bottom layers disposed below the one or more elastic modules, wherein:

the one or more elastic modules comprise a plurality of elastic members, middle parts of the plurality of elastic members are disposed with connecting members, adjacent elastic members of the plurality of elastic members are connected to each other by corresponding ones of the connecting members, connecting structures of side surfaces of a corresponding one of the connecting members of the plurality of elastic members comprise one or more first connecting structures and one or more second connecting structures, the one or more first connecting structures and the one or more second connecting structures are disposed on adjacent ones of the side surfaces of the corresponding one of the connecting members, bottom surfaces of the plurality of elastic members are connected to the one or more bottom layers, and each of the one or more bottom layers is an integrated structure or each of the one or more bottom layers comprises a plurality of bottom layer units detachably spliced together.

24. An elastic mattress for furniture, comprising:

one or more elastic modules, and one or more bottom layers disposed below the one or more elastic modules, wherein:

the one or more elastic modules comprise a plurality of elastic members, middle parts of the plurality of elastic members are disposed with connecting members, adjacent elastic members of the plurality of elastic members are connected to each other by corresponding ones of the connecting members, connecting structures of side surfaces of a corresponding one of the connecting members of the plurality of elastic members comprise one or more first connecting structures and one or more second connecting structures, the one or more first connecting structures and the one or more second connecting structures are disposed on adjacent ones of the side surfaces of the corresponding one of the connecting members, bottom surfaces of the plurality of elastic members are connected to the one or more bottom layers, and the plurality of elastic members are compressed to a locked state.

* * * * *